US009235162B2

(12) United States Patent
Makie et al.

(10) Patent No.: US 9,235,162 B2
(45) Date of Patent: Jan. 12, 2016

(54) DEVELOPER STORAGE CONTAINER AND IMAGE FORMING APPARATUS WITH SAME

(71) Applicant: KYOCERA Document Solutions Inc., Osaka-shi, Osaka (JP)

(72) Inventors: Ikuo Makie, Osaka (JP); Kenichi Tamaki, Osaka (JP); Minoru Wada, Osaka (JP); Shizuka Okada, Osaka (JP); Tamotsu Shimizu, Osaka (JP)

(73) Assignee: KYOCERA Document Solutions Inc. (JP)

( * ) Notice: Subject to any disclaimer, the term of this patent is extended or adjusted under 35 U.S.C. 154(b) by 4 days.

(21) Appl. No.: 14/090,268

(22) Filed: Nov. 26, 2013

(65) Prior Publication Data

US 2014/0147175 A1 May 29, 2014

(30) Foreign Application Priority Data

Nov. 28, 2012 (JP) ..... 2012-259584

(51) Int. Cl.
*G03G 15/08* (2006.01)

(52) U.S. Cl.
CPC ..... *G03G 15/0879* (2013.01); *G03G 2215/083* (2013.01); *G03G 2215/0827* (2013.01); *G03G 2215/0833* (2013.01)

(58) Field of Classification Search
CPC ..... G03G 15/0879; G03G 2215/0827; G03G 2215/083; G03G 2215/0833
USPC ..... 399/254, 258, 260, 262, 263
See application file for complete search history.

(56) References Cited

U.S. PATENT DOCUMENTS

| | | | | |
|---|---|---|---|---|
| 2005/0008400 | A1 * | 1/2005 | Tazawa et al. | 399/263 |
| 2012/0189350 | A1 * | 7/2012 | Kubota et al. | 399/254 |
| 2012/0263496 | A1 * | 10/2012 | Morita | |
| 2013/0101318 | A1 * | 4/2013 | Shimizu et al. | 399/258 |

FOREIGN PATENT DOCUMENTS

| | | | |
|---|---|---|---|
| JP | 5-46021 | | 2/1993 |
| JP | 2002268368 | A * | 9/2002 |
| JP | 2005250517 | A * | 9/2005 |

* cited by examiner

*Primary Examiner* — Walter L Lindsay, Jr.
*Assistant Examiner* — Milton Gonzalez
(74) *Attorney, Agent, or Firm* — Gerald E. Hespos; Michael J. Porco; Matthew T. Hespos

(57) ABSTRACT

A developer storage container includes a container main body, a tubular portion projecting from the container main body, and a rotary member extending from the container main body to the tubular portion. The rotary member includes a first section located in the container main body and a second section located in the tubular portion. A first conveying member for conveying developer in a first conveying direction is arranged on the second section of a rotary shaft, and a second conveying member for conveying the developer in a second conveying direction is arranged radially outwardly of the first conveying member around the first section. A first flexible member radially extending to a side outward of the second conveying member and a second flexible member radially extending to a side outward of the second conveying member and having a shorter length than the first flexible member are mounted on the rotary shaft.

13 Claims, 14 Drawing Sheets

DEVELOPER STORAGE CONTAINER AND IMAGE FORMING APPARATUS WITH SAME

This application is based on Japanese Patent Application Serial No. 2012-259584 filed with the Japan Patent Office on Nov. 28, 2012, the contents of which are hereby incorporated by reference.

BACKGROUND

The present disclosure relates to a developer storage container for storing developer and an image forming apparatus mounted with the developer storage container.

An image forming apparatus for forming an image on a sheet using developer is provided with a developer storage container such as a toner container. The toner container is a container for storing toner (developer) to be supplied to a developing device, and is detachably mounted in the image forming apparatus by a user. Generally, the toner container includes a container main body which serves as a toner storage space, a toner discharge opening provided at a suitable position of the bottom wall of the container main body and a conveyor screw for conveying the toner toward this toner discharge opening. Further, the conveyor screw is known to have a double structure composed of an inner side and an outer side.

In the case of arranging the conveyor screw having the double structure as described above in the toner container, the conveyor screw conveys the toner in a conveying direction toward the toner discharge opening and, simultaneously, conveys a part of the toner in a direction opposite to the conveying direction. In this case, the toner is conveyed in opposite directions near the outer periphery of the conveyor screw and in an inner part. Under a condition that the fluidity of the toner in the toner container is poor, the toner in a cylindrical space corresponding to a rotation area of the conveyor screw flows and the toner located outside that space is difficult to flow in some cases. As a result, there has been a problem that the toner in the toner container is aggregated in a tunnel-like manner around the conveyor screw.

To suppress such aggregation of the toner in the toner container, it is considered to provide a flexible member extending radially outward from the conveyor screw. In this case, the toner around the conveyor screw is agitated with the rotation of the flexible member to suppress the aggregation of the toner. However, in the case of arranging the flexible member, the flexible member tends to wind around an outer peripheral part of the conveyor screw with the rotation of the flexible member. As a result, the interior of the conveyor screw is partly sealed by the flexible member, causing a problem that the toner inside is retained.

An object of the present disclosure is to suppress the retention of developer in a rotary member in a developer storage container provided with the rotary member having a double structure and a flexible member projecting radially outward from the rotary member.

SUMMARY

A developer storage container according to one aspect of the present disclosure includes a container main body, a tubular portion and a rotary member. The container main body includes a bottom wall extending in one direction and stores developer. The tubular portion projects from the container main body while being connected to the bottom wall and includes a developer discharge opening through which the developer is discharged. The rotary member extends from the container main body to the tubular portion and conveys the developer in the container main body. The rotary member includes a rotary shaft, a first conveying member, a second conveying member, a first flexible member and a second flexible member.

The rotary shaft extends in an extending direction of the bottom wall and includes a first section located in the container main body and a second section located in the tubular portion. The first conveying member spirally projects on a circumferential surface of the second section of the rotary shaft and rotates together with the rotary shaft and conveys the developer in a first conveying direction from the tubular portion toward the container main body. The second conveying member is spirally arranged around the first section and at a side radially outward of the first conveying member, includes a hollow part through which the rotary shaft with the first conveying member is inserted, and rotates together with the rotary shaft and conveys the developer in a second conveying direction from the container main body toward the tubular portion. The first flexible member projects in a radial direction of the rotary shaft from a circumferential surface of the first section of the rotary shaft and includes a first end portion extending to a side outward of the second conveying member in the radial direction. The second flexible member radially projects from the circumferential surface of the first section of the rotary shaft while being spaced apart in a circumferential direction of the rotary shaft from the first flexible member and includes a second end portion extending in the radial direction to a side outward of the second conveying member and having a shorter length than the first flexible member.

An image forming apparatus according to another aspect of the present disclosure includes an image bearing member for bearing a developer image on a circumferential surface, a developing device including a developing roller for supplying developer to the circumferential surface of the image bearing member, and a developer storage container to be assembled with the developing device for supplying the developer to the developing device.

These and other objects, features and advantages of the present disclosure will become more apparent upon reading the following detailed description along with the accompanying drawings.

DETAILED DESCRIPTION

Figure 1:
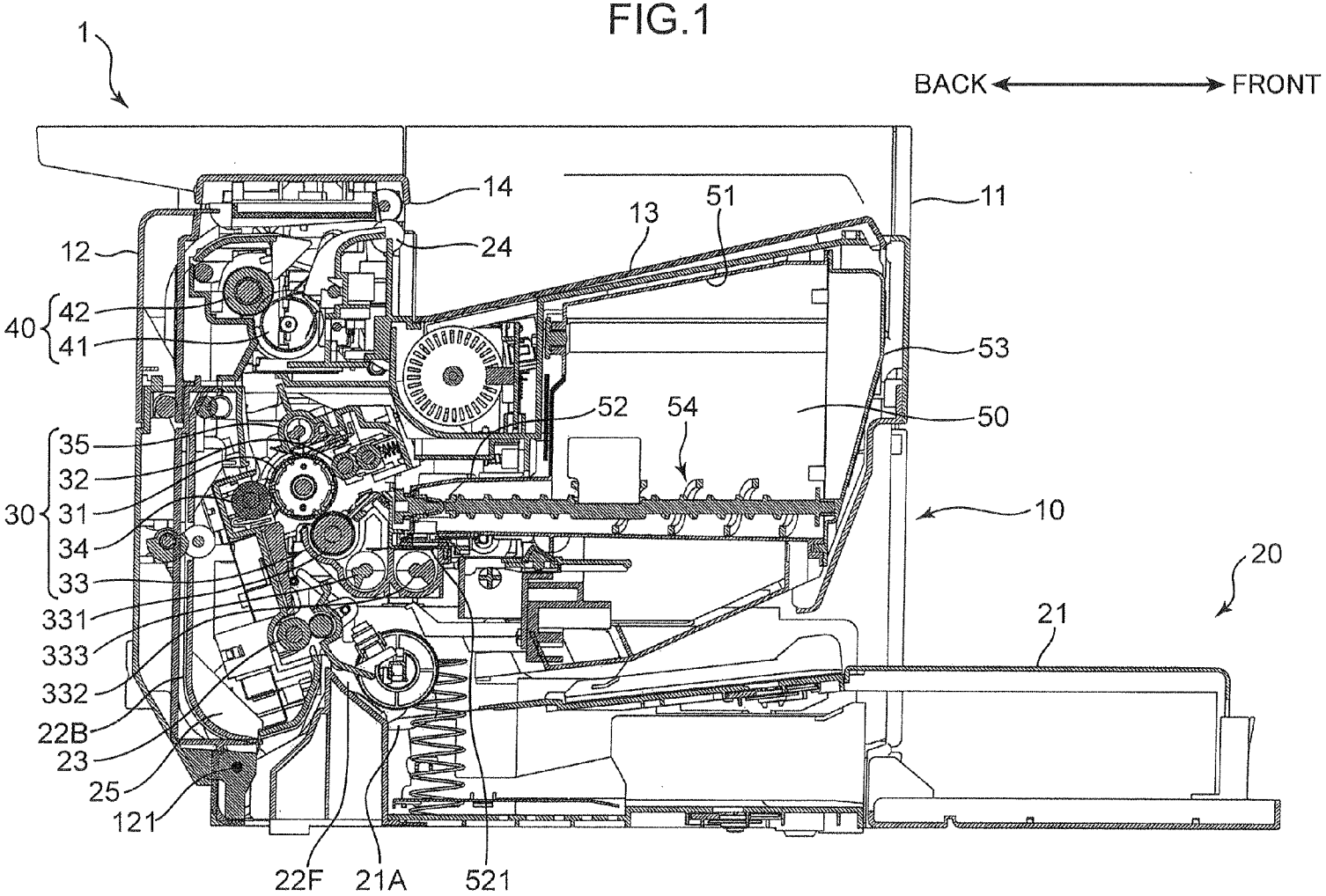
FIG. 1 is a sectional view showing an internal structure of an image forming apparatus according to one embodiment of the present disclosure.

Hereinafter, an embodiment of the present disclosure is described in detail based on the drawings. FIG. 1 is a sectional view showing an internal structure of an image forming apparatus 1 according to one embodiment of the present disclosure. Although a black-and-white printer is illustrated as the image forming apparatus 1 here, the image forming apparatus may be a copier, a facsimile machine or a complex machine provided with these functions or may be an image forming apparatus for forming a color image.

The image forming apparatus 1 includes a main body housing 10 having a substantially rectangular parallelepipedic housing structure and a sheet feeding unit 20, an image forming unit 30, a fixing unit 40 and a toner container 50 (developer storage container) housed in this main body housing 10.

A front cover 11 and a rear cover 12 are respectively provided on a front side (right side in FIG. 1) and a rear side of the main body housing 10. A user can take the toner container 50 out from the front side of the main body housing 10 by opening the front cover 11 when toner runs out. The rear cover 12 is a cover which is opened in the event of a sheet jam and maintenance. Each of the image forming unit 30 and the fixing unit 40 can be respectively taken out from the rear side of the main body housing 10 by opening the rear cover 12. Further, a sheet discharge unit 13 to which a sheet after image formation is discharged is provided on the upper surface of the main body housing 10.

The sheet feeding unit 20 includes a sheet cassette 21 for storing sheets to which an image forming process is applied. A part of this sheet cassette 21 projects forward from the front surface of the main body housing 10. The sheet cassette 21 includes a sheet storage space in which a stack of the sheets is stored, a lift plate for lifting up the stack of sheets for sheet feeding and the like. A sheet pickup device 21A is provided above a rear end side of the sheet cassette 21. A pickup roller (not shown) for picking up the uppermost sheet of the sheet stack in the sheet cassette 21 one by one is arranged in this sheet pickup device 21A.

The image forming unit 30 performs an image forming process for forming a toner image on a sheet fed from the sheet feeding unit 20. The image forming unit 30 includes a photoconductive drum 31 (image bearing member), and a charging device 32, an exposure device (not shown in FIG. 1), a developing device 33, a transfer roller 34 and a cleaning device 35 arranged around this photoconductive drum 31.

The photoconductive drum 31 is rotated about its shaft and an electrostatic latent image and a toner image (developer image) are formed on a circumferential surface thereof. A photoconductive drum made of an amorphous silicon (a-Si) based material can be used as the photoconductive drum 31. The charging device 32 is for uniformly charging the surface of the photoconductive drum 31 and includes a charging roller held in contact with the photoconductive drum 31. The exposure device includes optical devices such as a laser light source, a mirror and a lens and irradiates the circumferential surface of the photoconductive drum 31 with light modulated based on image data given from an external apparatus such as a personal computer, thereby forming an electrostatic latent image.

The developing device 33 supplies toner to the circumferential surface of the photoconductive drum 31 to develop the electrostatic latent image on the photoconductive drum 31 and form a toner image. The developing device 33 includes a developing roller 331 for bearing the toner to be supplied to the photoconductive drum 31 and a first conveyor screw 332 and a second conveyor screw 333 for conveying developer in a circulating manner while agitating the developer in a development housing 60 (see FIGS. 2 to 5). This developing device 33 is described in detail later.

The transfer roller 34 is a roller for transferring a toner image formed on the circumferential surface of the photoconductive drum 31 onto a sheet and forms a transfer nip portion together with the photoconductive drum 31. A transfer bias having a polarity opposite to that of the toner is applied to this transfer roller 34. The cleaning device 35 includes a cleaning roller and the like and cleans the circumferential surface of the photoconductive drum 31 after the transfer of the toner image.

The fixing unit 40 performs a fixing process for fixing a transferred toner image onto a sheet. The fixing unit 40 includes a fixing roller 41 internally provided with a heat source and a pressure roller 42 pressed into contact with this fixing roller 41 and forming a fixing nip portion together with the fixing roller 41. When a sheet having a toner image transferred thereto is passed through the fixing nip portion, the toner image is fixed onto the sheet by heating by the fixing roller 41 and pressing by the pressure roller 42.

The toner container 50 is assembled to the developing device 33 and stores the toner (developer) to be supplied to the developing device 33. The toner container 50 includes a container main body 51 (container main body) as a main storage part for the toner, a tubular portion 52 projecting from a lower part of one side surface of the container main body 51, a lid member 53 covering another side surface of the container main body 51, and a rotary member 54 housed in the container for conveying the toner. The toner stored in the toner container 50 is supplied into the developing device 33 through a toner discharge opening 521 (developer discharge opening) provided on the lower surface of the tip of the tubular portion 52 by driving and rotating the rotary member 54. This toner container 50 is described in detail later.

A main conveyance path 22F and a reversing conveyance path 22B are provided to convey a sheet in the main body housing 10. The main conveyance path 22F extends from the sheet pickup device 21A of the sheet feeding unit 20 to a sheet discharge opening 14 provided to face the sheet discharge unit 13 on the upper surface of the main body housing 10 by way of the image forming unit 30 and the fixing unit 40. The reversing conveyance path 22B is a conveyance path for returning a sheet, one side of which is printed, to a side of the main conveyance path 22F upstream of the image forming unit 30 in the case of printing both sides of the sheet.

A pair of registration rollers 23 are arranged in a side of the main conveyance path 22F upstream of the transfer nip portion between the photoconductive drum 31 and the transfer roller 34. A sheet is temporarily stopped at the pair of registration rollers 23 and fed to the transfer nip portion at a predetermined timing for image transfer after a skew correction is made. A plurality of conveyor rollers for conveying a sheet are arranged at suitable positions of the main conveyance path 22F and the reversing conveyance path 22B. For example, a pair of discharge rollers 24 are arranged near the sheet discharge opening 14.

The reversing conveyance path 22B is formed between the outer side surface of a reversing unit 25 and the inner surface of the rear cover 12 of the main body housing 10. Note that the transfer roller 34 and one of the pair of registration rollers 23 are mounted on the inner side surface of the reversing unit 25. The rear cover 12 and the reversing unit 25 are respectively rotatable about a supporting point portion 121 provided at the lower ends thereof. If a sheet jam occurs in the rear conveyance path 22B, the rear cover 12 is opened. If a sheet jam occurs in the main conveyance path 22F or if a unit including the photoconductive drum 31 or the developing device 33 is taken out to the outside, the reversing unit 25 is also opened in addition to the rear cover 12.

Figure 2:
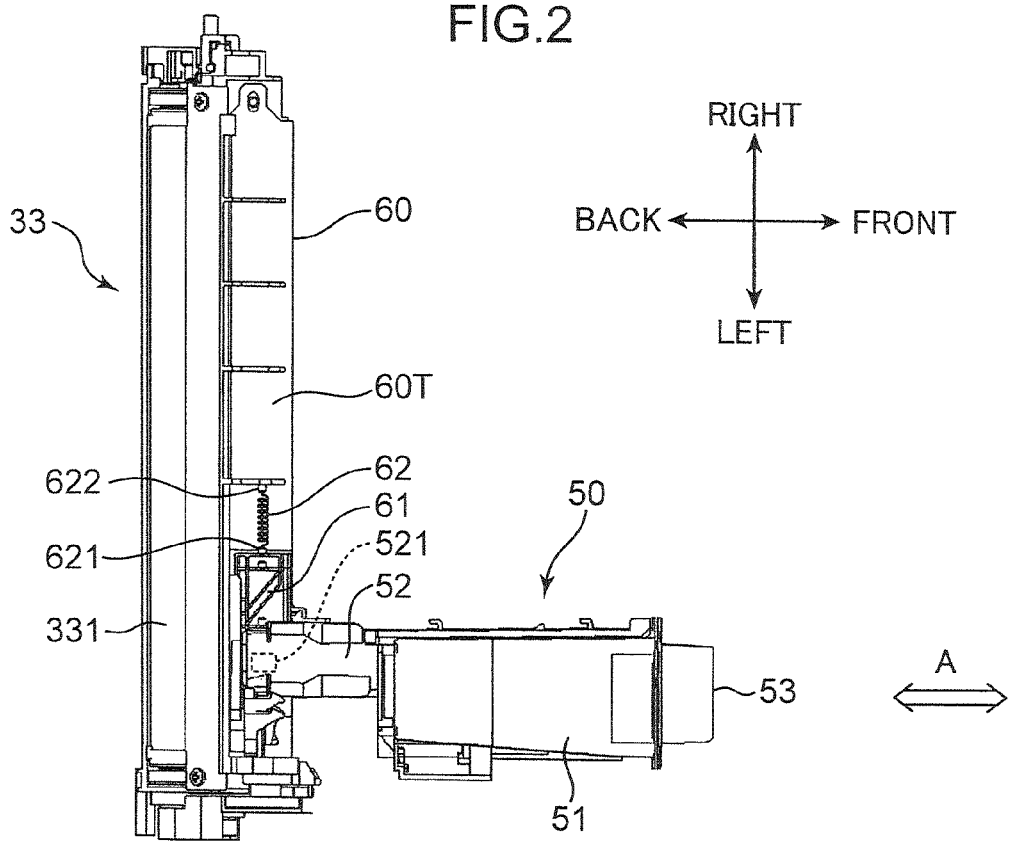
FIG. 2 is a plan view showing a developing device and a toner container incorporated in the image forming apparatus.
Figure 3:
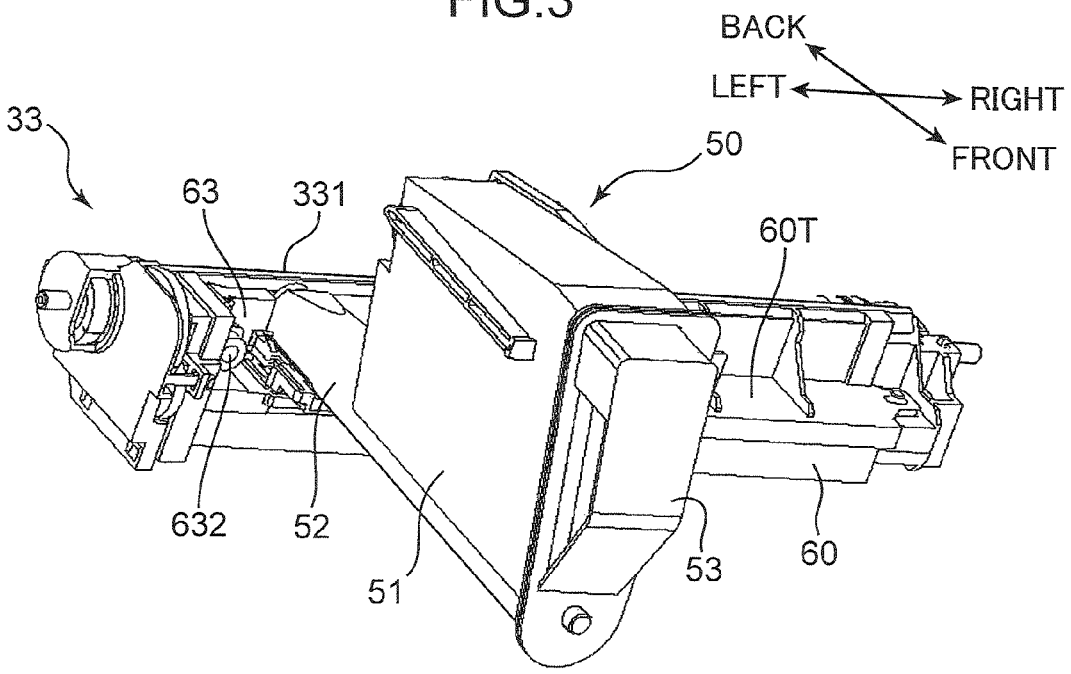
FIG. 3 is a perspective view of the developing device and the toner container shown in FIG. 2.
Figure 4:
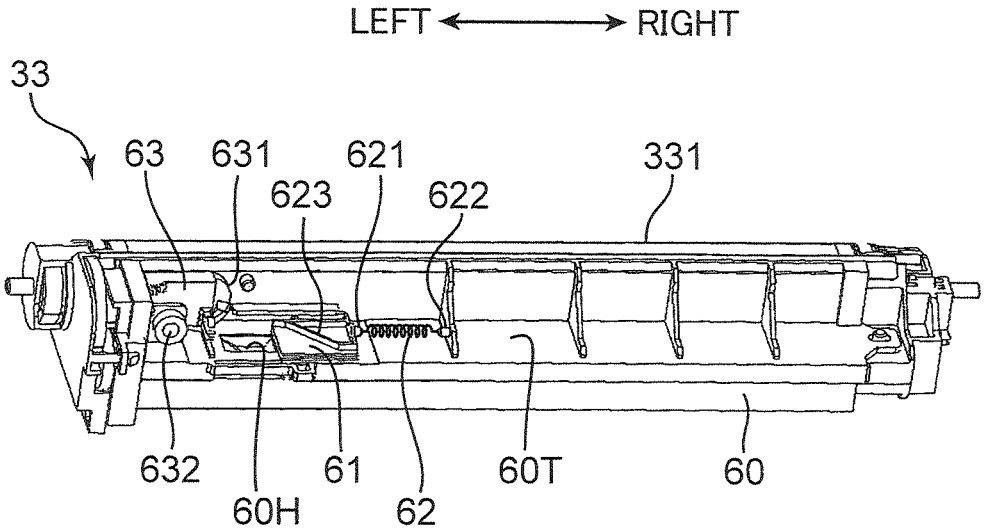
FIG. 4 is a perspective view of the developing device alone.
Figure 5:
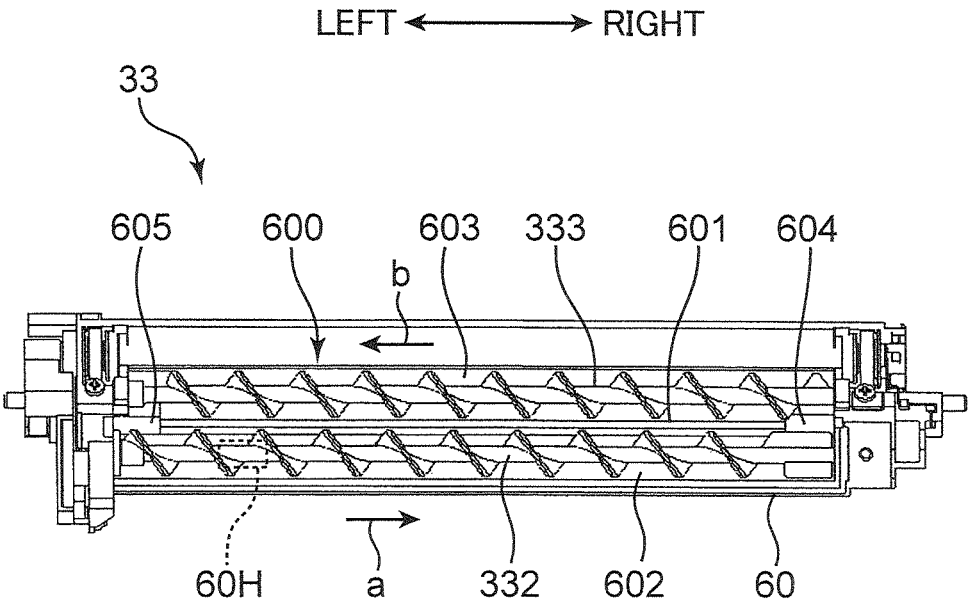
FIG. 5 is a plan view showing an internal structure of the developing device.

Next, the structures and arrangement relationship of the developing device 33 and the toner container 50 are described with reference to FIGS. 2 to 5. FIG. 2 is a plan view and FIG. 3 is a perspective view showing an assembled state of the developing device 33 and the toner container 50, FIG. 4 is a perspective view of the developing device 33 alone, and FIG. 5 is a plan view showing an internal structure of the developing device 33.

The developing device 33 includes the development housing 60 having a box shape long in one direction (axial direction of the developing roller 331). The development housing 60 is formed with an opening extending in a longitudinal direction thereof, and a part of the circumferential surface of the developing roller 331 is exposed through this opening. In this embodiment, the development housing 60 is so assembled into the main body housing 10 that the longitudinal direction thereof coincides with a lateral direction of the main body housing 10.

A toner supply opening 60H used to receive the toner supplied from the toner container 50 into the development housing 60 is perforated in a ceiling plate 60T near the left end of the development housing 60. The developing device 33 and the toner container 50 are so assembled that this toner supply opening 60H and the toner discharge opening 521 of the toner container 50 vertically overlap. The toner container 50 is attached to and detached from the developing device 33 in directions (forward and backward directions/second direction) perpendicular to the longitudinal direction of the development housing 60 as shown by arrows A in FIG. 2. Since the toner container 50 has a housing shape long in one direction when viewed from above, a substantially L-shaped structure is formed when viewed from above (see FIG. 2) in a state where the toner container 50 is attached to the developing device 33.

A developer shutter plate 61 slidable in the lateral direction is arranged on the upper surface of the ceiling plate 60T. The developer shutter plate 61 is constantly biased leftward by a biasing spring 62. The biasing spring 62 is a coil spring and end parts thereof are attached to spring seats 621, 622 respectively provided on the right end edge of the developer shutter plate 61 and a rib adjacent to the developer shutter plate 61. Although the toner supply opening 60H in an open state is shown in FIG. 4, the developer shutter plate 61 is located on the left side and closes the toner supply opening 60H by being biased by the biasing spring 62 in a state where the toner container 50 is not attached.

A pressing plate 522 is mounted on a lower part of the tip edge (other end portion 524) of the tubular portion 52 of the toner container 50. Further, a container gear 54G for inputting a rotational drive force to the rotary member 54 is arranged and exposed on the tip surface of the tubular portion 52. A gear holder 63 including an input gear 631 and a coupling 632 is arranged at a left back side of the toner supply opening 60H of the development housing 60. A rotational drive force from an unillustrated motor provided in the main body housing 10 is applied to the coupling 632. The input gear 631 is engaged with the container gear 54G with the toner container 50 attached to the developing device 33 and transmits the rotational drive force to the container gear 54G.

In attaching the toner container 50 to the developing device 33, the tubular portion 52 of the toner container 50 is inserted backward into the toner supply opening 60H from front. At this time, the pressing plate 522 of the toner container 50 interferes with the developer shutter plate 61 closing the toner supply opening 60H and moves the developer shutter plate 61 rightward. Specifically, an oblique elongated projection 623 projecting on the upper surface of the developer shutter plate 61 and the pressing plate 522 interfere with each other and the developer shutter plate 61 is pushed rightward against a biasing force of the biasing spring 62. When the tubular portion 52 of the toner container 50 is inserted to a predetermined position, the toner supply opening 60H is completely opened and the container gear 54G is engaged with the input gear 631.

With reference to FIG. 5, the development housing 60 includes an internal space 600. In the case of two-component development method, developer composed of toner and carrier is filled in this internal space 600. The carrier is agitated and mixed with the toner in the internal space 600 to charge the toner and convey the toner to the developing roller 331. The toner is successively supplied to the developing roller 331 to be consumed and a consumed amount of the toner is appropriately supplied from the toner container 50.

The internal space 600 of the development housing 60 is partitioned into a first passage 602 and a second passage 603 long in the lateral direction by a partition plate 601 extending in the lateral direction. The partition plate 601 is shorter than the width of the development housing 60 in the lateral direction, and a first communicating portion 604 and a second communicating portion 605 are provided on the right and left ends of the partition plate 601 to allow communication between the first and second passages 602, 603. In this way, a circulation path composed of the first passage 602, the first communicating portion 604, the second passage 603 and the second communicating portion 605 is formed in the development housing 60.

The toner supply opening 60H described above is arranged above the vicinity of the left end of the first passage 602. The first conveyor screw 332 is housed in the first passage 602 and the second conveyor screw 333 is housed in the second passage 603. Each of the first and second conveyor screws 332, 333 includes a shaft and a blade member spirally projecting on the outer periphery of this shaft. The first conveyor screw 332 is driven and rotated about the shaft to convey the developer in a direction of an arrow "a" of FIG. 5. On the other hand, the second conveyor screw 333 is driven and rotated about the shaft to convey the developer in a direction of an arrow "b".

By driving and rotating the first and second conveyor screws 332, 333, the developer is conveyed in a circulating manner along the above circulation path. The toner supplied through the toner supply opening 60H anew is described. This toner drops into the first passage 602 and is mixed with the existing developer and conveyed in the direction of the arrow "a" by the conveyor screw 332. At this time, the toner is agitated with the carrier to be charged. Subsequently, the toner enters the second passage 603 through the first communicating portion 604 from a downstream end of the first passage 602, and is conveyed in the direction of the arrow "b" by the second conveyor screw 333. During this conveyance, the toner is partly supplied to the circumferential surface of the developing roller 331 while being similarly charged. The remaining toner and the carrier are returned to an upstream end of the first passage 602 through the second communicating portion 605.

Figure 6:
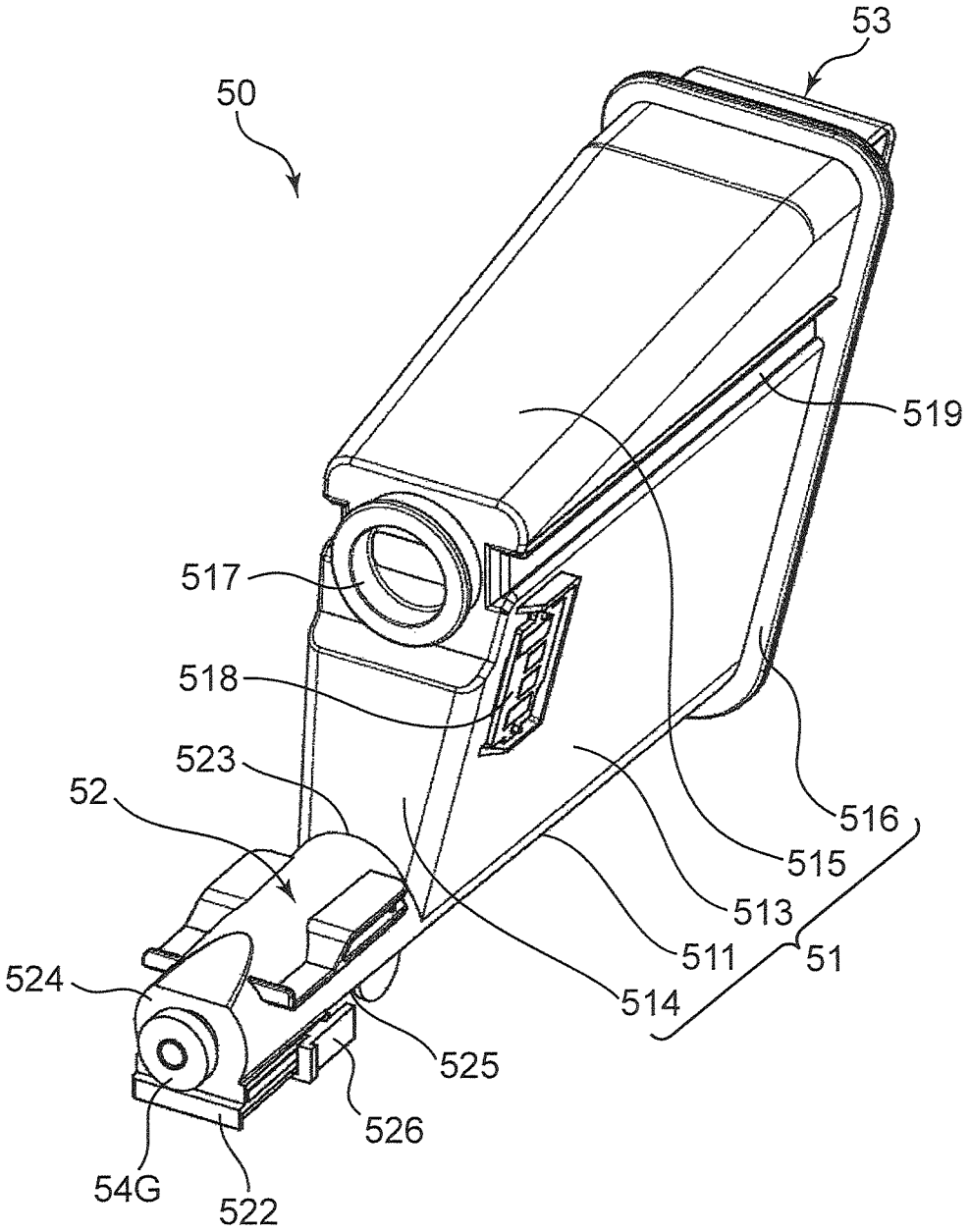
FIG. 6 is a perspective view of the toner container.
Figure 7:
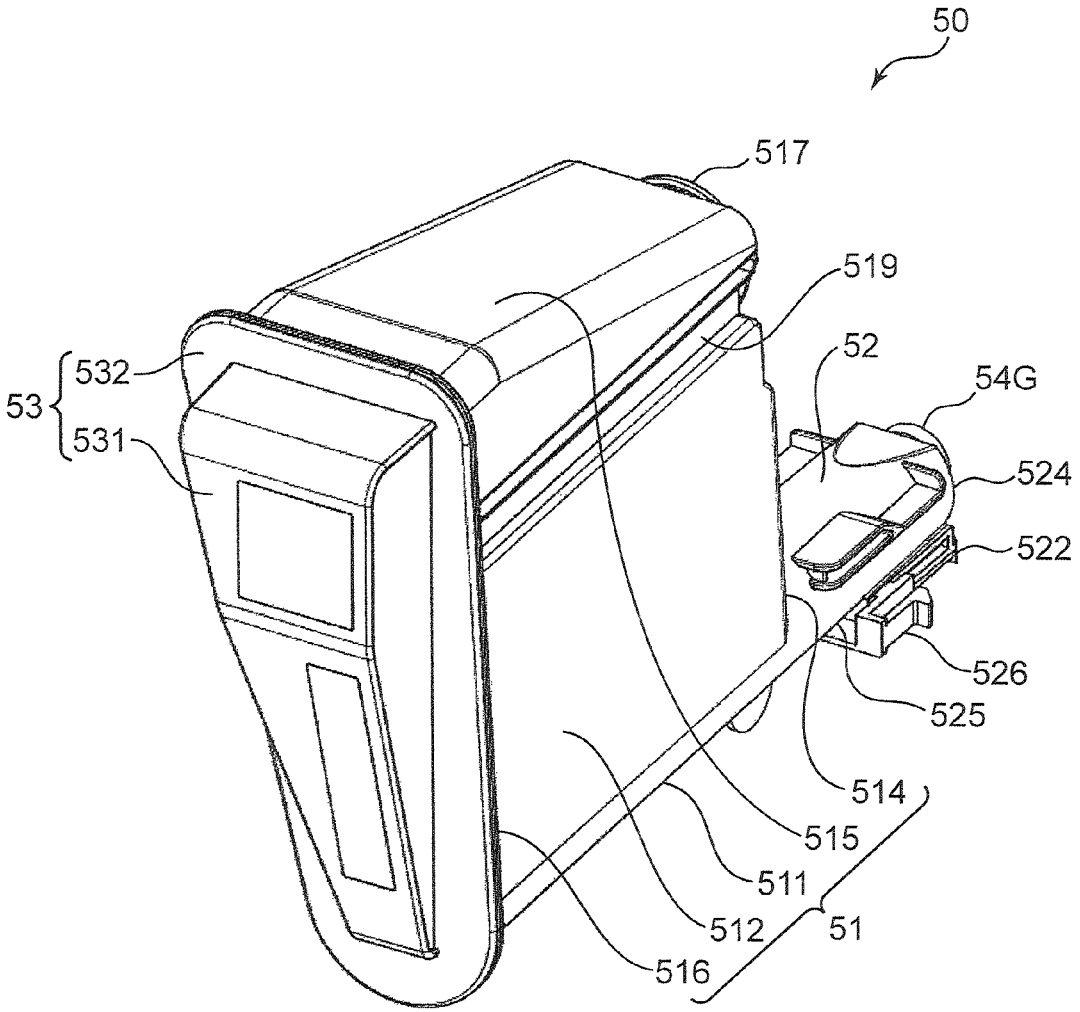
FIG. 7 is a perspective view of the toner container viewed in a direction 180° different from that in FIG. 6.
Figure 8:
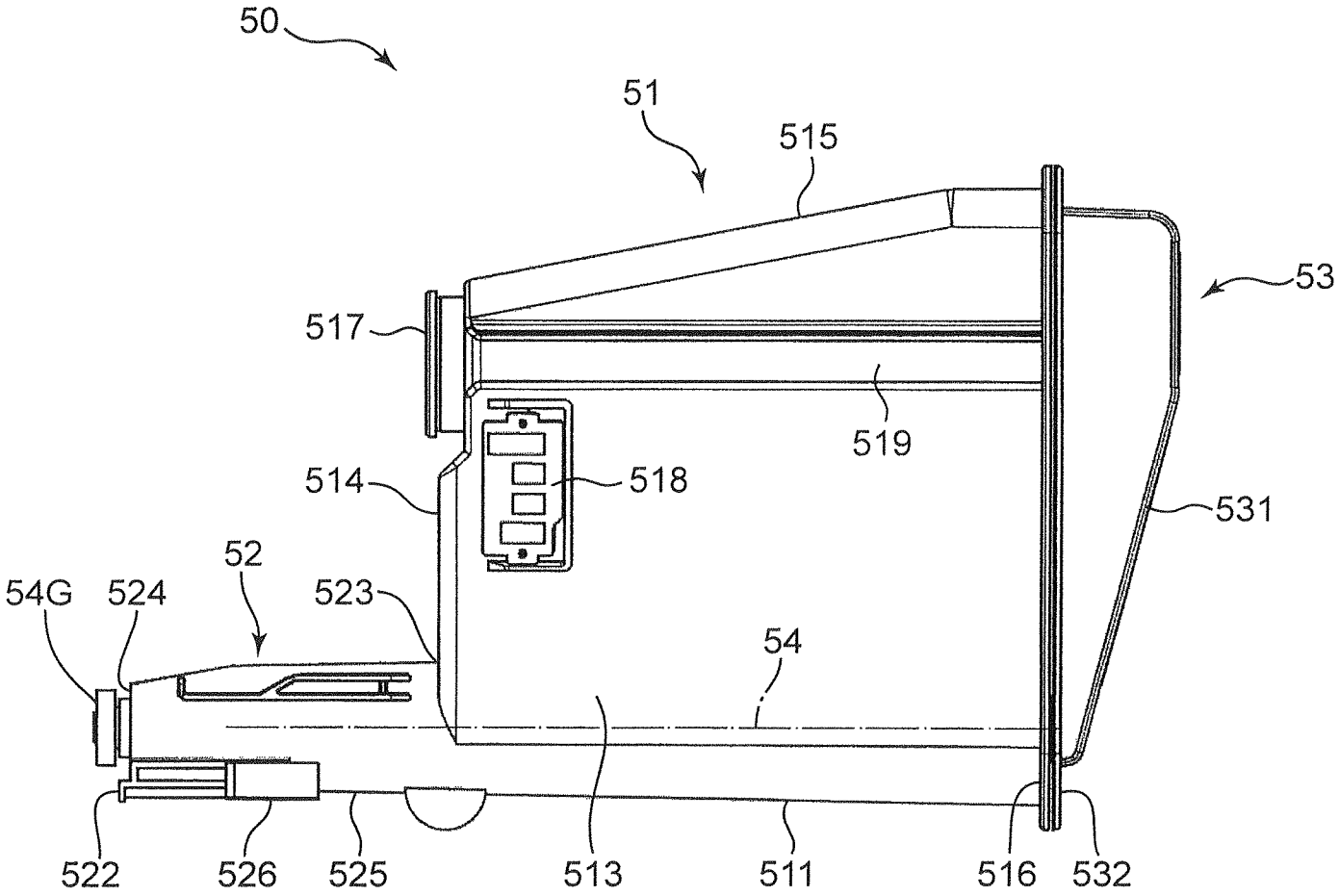
FIG. 8 is a side view of the toner container.
Figure 9:
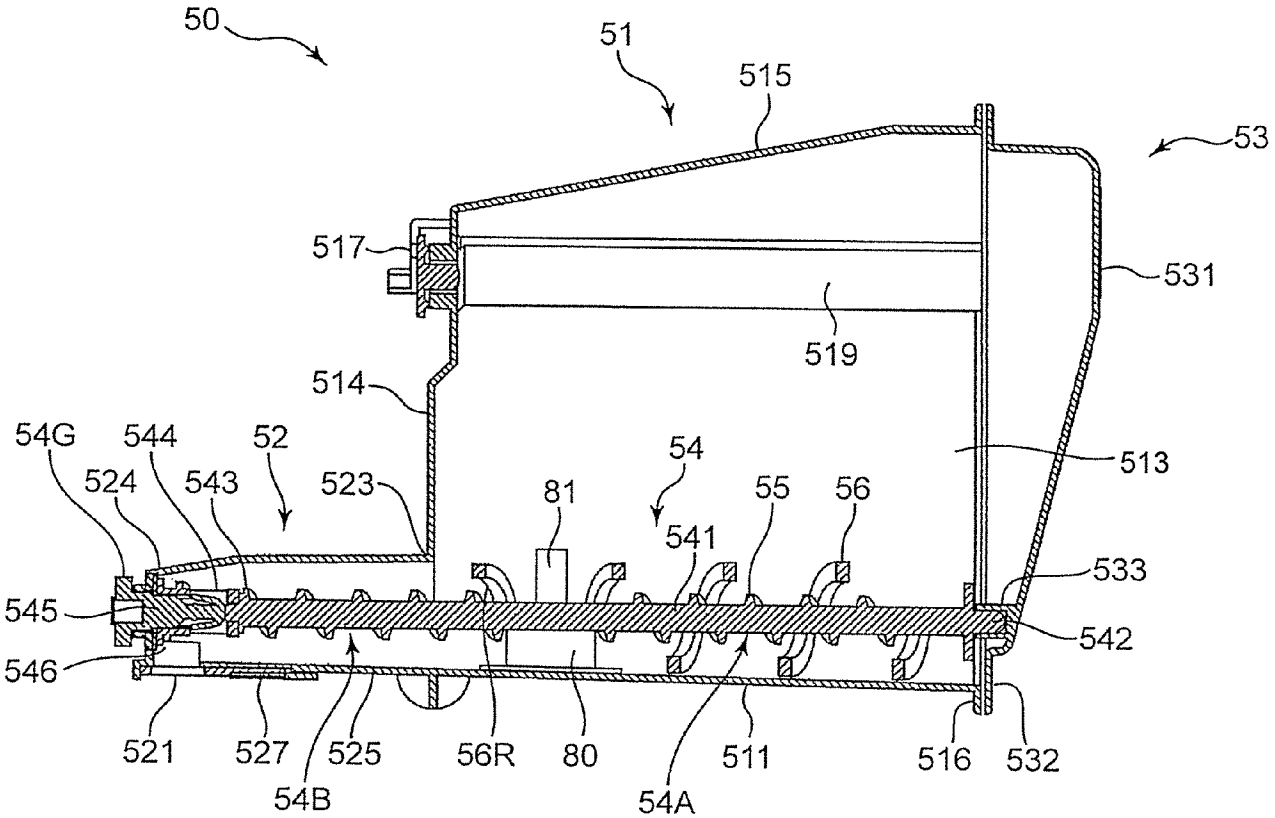
FIG. 9 is a side view in section of the toner container.
Figure 10:
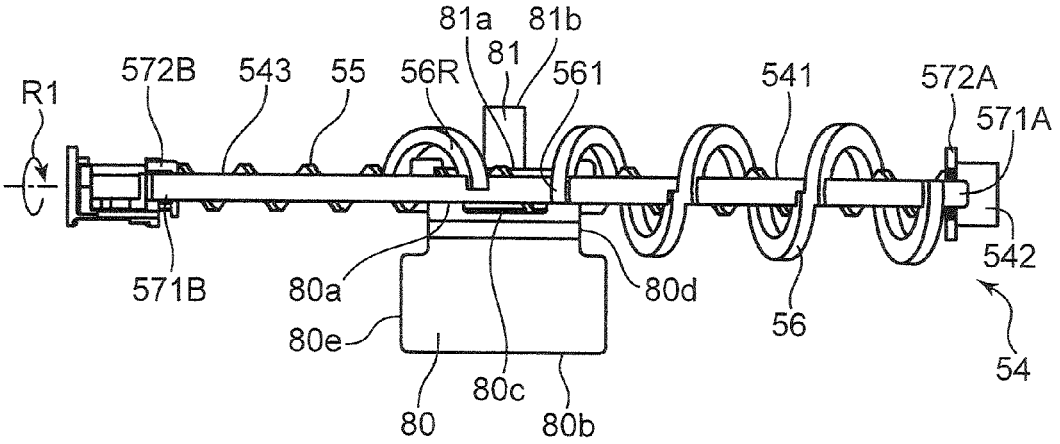
FIG. 10 is a plan view of a rotary member arranged in the toner container.
Figure 11:
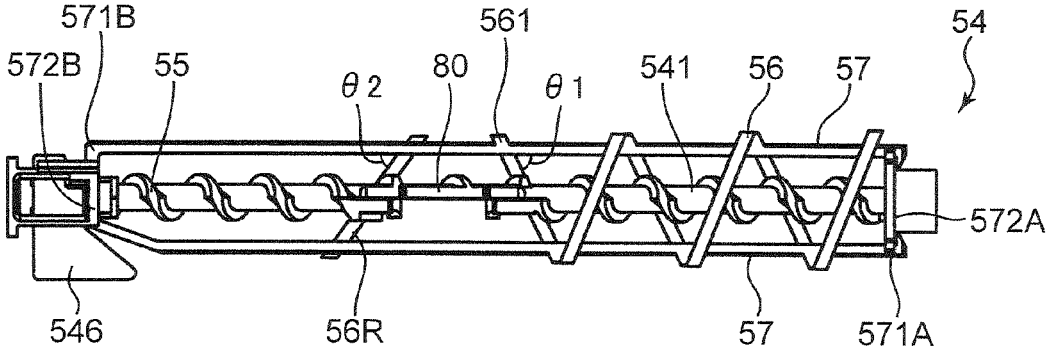
FIG. 11 is a front view of the rotary member.
Figure 12:
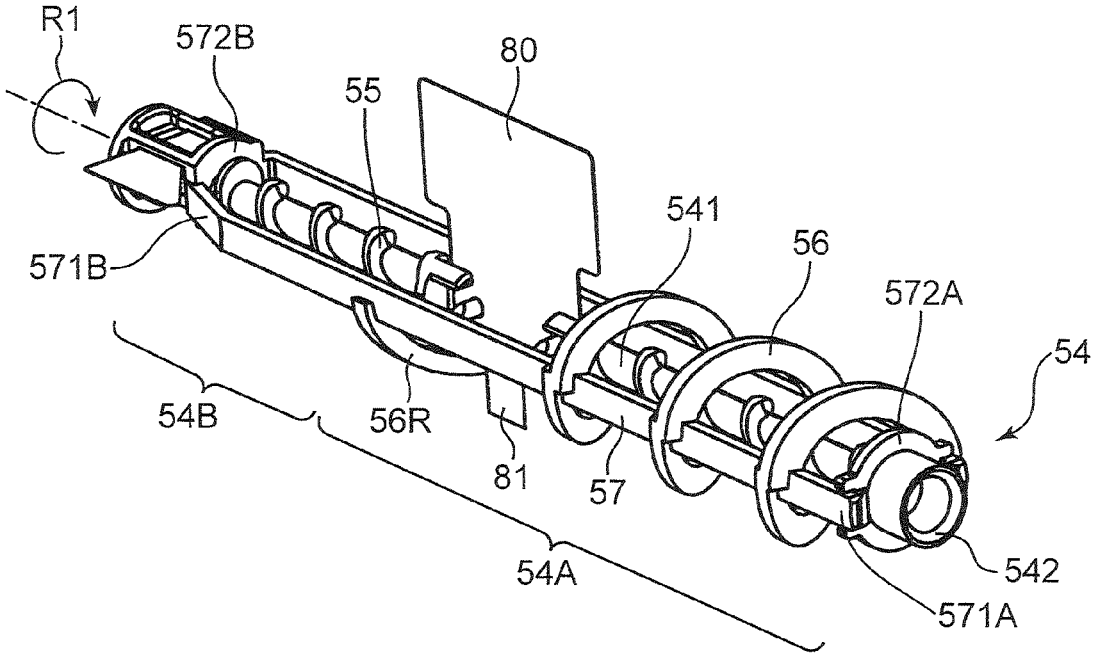
FIG. 12 is a perspective view of the rotary member.
Figure 13:
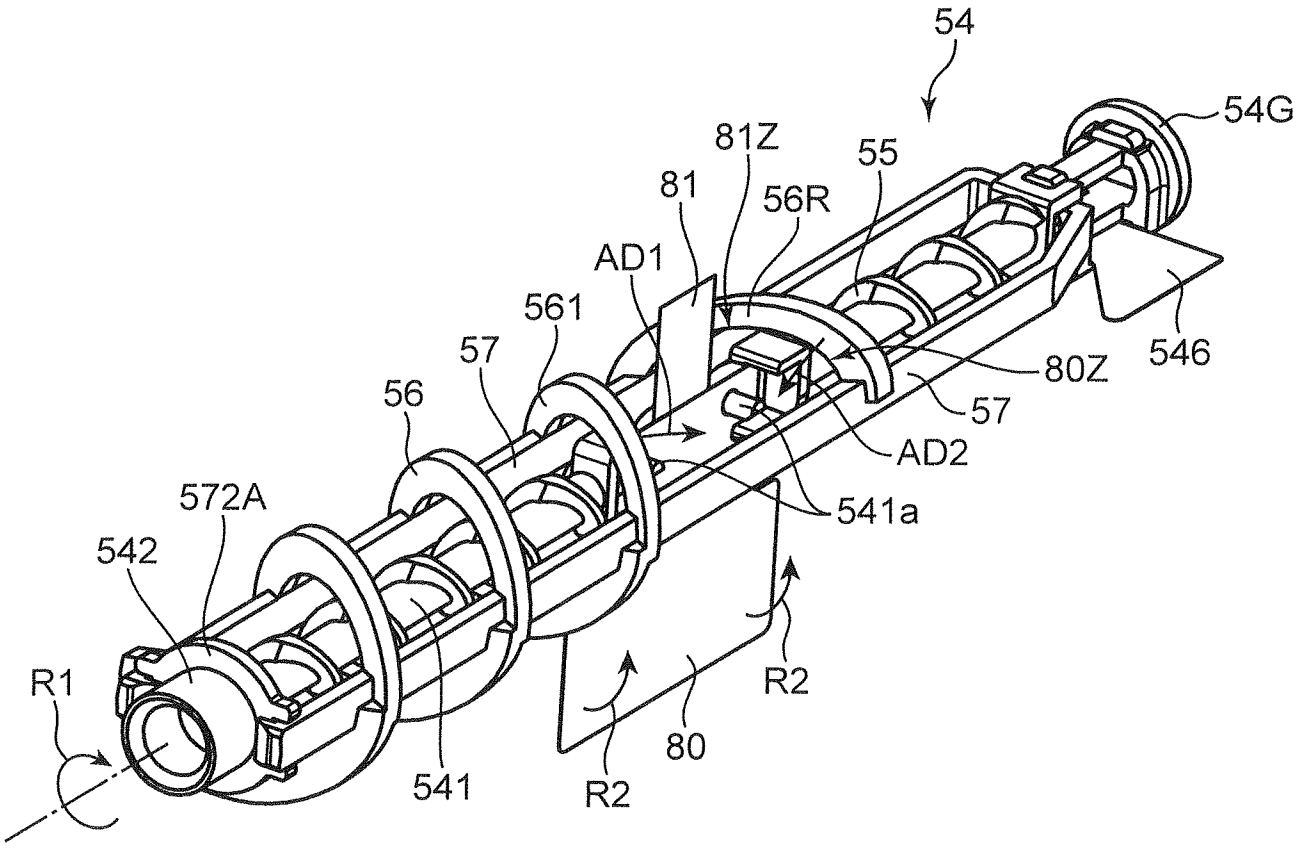
FIG. 13 is a perspective view of the rotary member.
Figure 14:
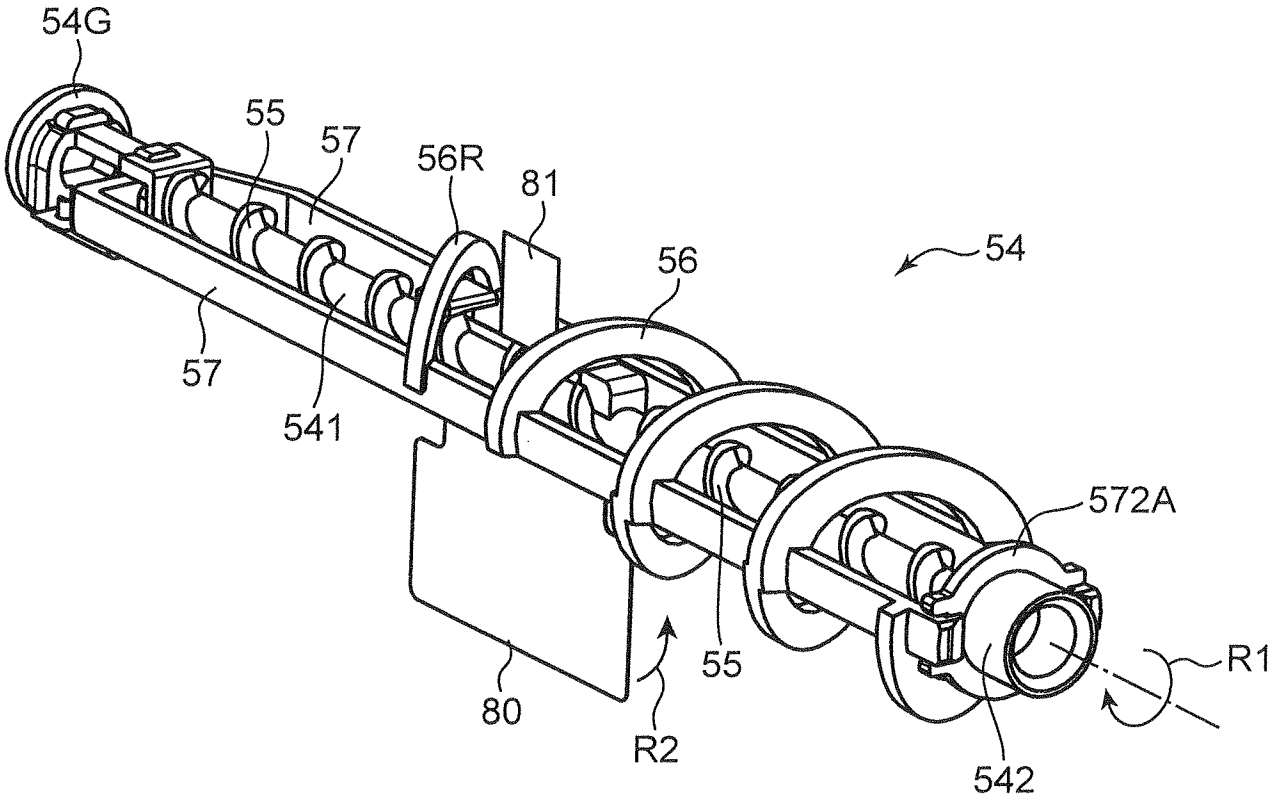
FIG. 14 is a perspective view of the rotary member.

Next, a detailed structure of the toner container 50 is described with reference to FIGS. 6 to 14. FIG. 6 is a perspective view of the toner container 50 viewed from the tubular portion 52 side (rear side in FIG. 1), FIG. 7 is a perspective view viewed from the lid member 53 side by changing a viewing direction by 180°, FIG. 8 is a side view and FIG. 9 is a side view in section of the toner container 50, FIGS. 10 and 11 are respectively a plan view and a front view of the rotary member 54 arranged in the toner container 50 and FIGS. 12 to 14 are perspective view of the rotary member 54.

As already described, the toner container 50 includes the container main body 51, the tubular portion 52, the lid member 53 and the rotary member 54. To form a space for storing the toner, the container main body 51 includes a bottom wall 511 extending in one direction and having a semicircular cross-section, a first side wall 512 extending upward from one end edge of the bottom wall 511, a second side wall 513 extending upward from the other end edge of the bottom wall 511 and facing the first side wall 512, a third side wall 514 connecting the first and second side walls 512, 513 on an end edge part of the tubular portion 52 side, a ceiling wall 515 connecting the upper end edges of the first and second side walls 512, 513, and a first flange portion 516 formed on an end edge at a side facing the lid member 53. Note that the first flange portion 516 side of the container main body 51 is a laterally open surface.

The container main body 51 has such a vertically long external shape that a part with the bottom wall 511 is narrowest and a spacing between the first and second side walls 512, 513 is gradually widened from the bottom wall 511 toward an upper side. The first and second side walls 512, 513 are plate-like members and have a straight inner surface in a cross-section.

A cap 517 for closing an opening used to fill the toner into the container main body 51 is mounted on an upper part of the third side wall 514. A wireless tag 518 recorded with management information of this toner container 50 is attached to the second side wall 513. Further, a pair of groove portions 519 parallel to an extending direction of the bottom wall 511 are formed on the first and second side walls 512, 513 near upper end parts. These groove portions 519 are parts to be guided by unillustrated guide members of the main body housing 10 in mounting the toner container 50 into the main body housing 10.

The tubular portion 52 is a cylindrical part projecting from the third side wall 514 and connected to the bottom wall 511. One end portion 523 of the tubular portion 52 is connected to a lower end part of the third side wall 514 and an internal space of the container main body 51 and that of the tubular portion 52 communicate. Another end portion 524 of the tubular portion 52 is a projecting end of the tubular portion 52, and the container gear 54G is arranged to project further outward from the other end portion 524.

A bottom portion 525 of the tubular portion 52 is flush with the bottom wall 511 of the container main body 51, whereby a gutter-like part having a semicircular cross-section is formed from the first flange portion 516 to the other end portion 524. The tubular portion 52 has an inner wall surface having a circular cross-sectional shape along a radial direction of a rotary shaft 541 and is slightly tapered from the one end portion 523 toward the other end portion 524. An inner wall surface of the semicircular bottom wall 511 of the container main body 51 is connected to this circular inner wall surface of the tubular portion 52.

As described above, the tubular portion 52 includes the toner discharge opening 521 (developer discharge opening), through which the toner is discharged, and is attached to the developing device 33. The toner discharge opening 521 is a drop opening arranged on the bottom portion 525 (lower surface) of the tubular portion 52. An engaging portion 526 to be engaged with a part of the development housing 60 when the toner container 50 is attached is arranged on the bottom portion 525. The toner stored in the container main body 51 is fed to the tubular portion 52 and discharged through the toner discharge opening 521 by driving and rotating the rotary member 54 to be described later.

As shown in FIG. 9, the toner discharge opening 521 is provided at a position of the bottom portion 525 near the other end portion 524. A shutter plate 527 which slides along an extending direction of the tubular portion 52 is attached to the lower surface of the toner discharge opening 521. The shutter plate 527 is biased in a direction toward the other end portion 524 by an unillustrated biasing member to constantly close the toner discharge opening 521. On the other hand, in attaching the tubular portion 52 to the developing device 33, the shutter plate 527 interferes with a part of the development housing 60 and slides in a direction toward the one end portion 523. FIG. 9 shows a state where the shutter plate 527 is moved backward to open the toner discharge opening 521. Note that the shutter plate 527 and the above engaging portion 526 constitute an integral member.

The lid member 53 is for covering the laterally open surface of the container main body 51 and includes a lid main body 531 having a concave shape and a second flange portion 532 provided on the peripheral edge of the lid main body 531 and to be butted against the first flange portion 516. The lid main body 531 has an inclined surface inclined outward from bottom to top and a vertical surface connected to the upper end of this inclined surface. The vertical surface of the lid main body 531 is a part considerably projecting from the second flange portion 532 and the user can mount and detach the toner container 50 into and from the main body housing 10 by gripping this part. A shaft supporting portion 533 for rotatably supporting a first end portion 542 of the rotary shaft 541 of the rotary member 54 to be described later is provided at the lower end of the inner surface of the lid main body 531. The second flange portion 532 is welded to the first flange portion 516 with the first end portion 542 inserted in the shaft supporting portion 533.

<Structure of Rotary Member>

The rotary member 54 is a member which is arranged from the bottom wall 511 of the container main body 51 to the tubular portion 52 and conveys the toner in the container main body 51 by being driven and rotated about an axis. As shown in FIGS. 9 to 14, the rotary member 54 includes the rotary shaft 541, a film member 546 which rotates together with the rotary shaft 541, a first conveying member 55, a second conveying member 56 and a pair of dispersing members 57. Further, the rotary member 54 includes a spiral piece 56R (third conveying member) which rotates together with the rotary shaft 541, a first film 80 (first flexible member) and a second film 81 (second flexible member).

The rotary shaft 541 is arranged to extend in the extending direction of the bottom wall 511 and includes the first end portion 542 and a second end portion 543 on both ends thereof. The first end portion 542 is rotatably supported by the shaft supporting portion 533 of the lid member 53. A tubular holding piece 544 is integrally mounted on the second end portion 543. The container gear 54G and the rotary shaft 541 are united by fitting a trunk portion 545 of the container gear 54G into this tubular holding piece 544. The trunk portion 545 is rotatably supported at the other end portion 524 of the tubular portion 52. The rotary shaft 541 extends from the container main body 51 to the tubular portion 52 and is divided into a first section 54A arranged in the container main body 51 and a second section 54B arranged in the tubular portion 52.

The film member 546 is arranged on the tubular holding piece 544 and has a function of feeding the toner to the toner discharge opening 521. The film member 546 is a rectangular, thin and flexible PET film, projects in a direction perpendicular to an axial direction of the rotary shaft 541 and is attached to the circumferential surface of the tubular holding piece 544. The film member 546 turns when the rotary shaft 541 rotates, thereby causing the toner present near the other end portion 524 of the tubular portion 52 to flow and feeding the toner to the toner discharge opening 521.

The first conveying member 55 is a conveying member integral to the rotary shaft 541 and spirally projecting on the circumferential surface of the rotary shaft 541. The first conveying member 55 is formed substantially over the entire axial length of the rotary shaft 541. That is, the first conveying member 55 is formed on the circumferential surface of a part equivalent to both the first section 54A and the second section 54B of the rotary shaft 541. The first conveying member 55 integrally rotates with the rotary shaft 541 to convey the toner in a first conveying direction from the tubular portion 52 toward the container main body 51.

The second conveying member 56 is a hollow spiral conveying member arranged on the outer periphery of the rotary shaft 541 with gaps formed between the second conveying member 56 and the rotary shaft 541, the first conveying member 55. In other words, the second conveying member 56 is arranged at a side radially outward of the first conveying member 55 and includes a hollow part through which the rotary shaft 541 provided with the first conveying member 55 is inserted. The second conveying member 56 is arranged only in an area corresponding to the first section 54A. The second conveying member 56 integrally rotates with the rotary shaft 541 to convey the toner in a second conveying direction from the container main body 51 toward the tubular portion 52. The bottom wall 511 of the container main body 51 has a semicircular inner wall surface corresponding to a rotational path of a most radially projecting part of this second conveying member 56.

The pair of dispersing members 57 are rod-like members having substantially the same length as the rotary shaft 541 and arranged in parallel with the rotary shaft 541. Each dispersing member 57 connects respective spiral pieces (arch-like conveying pieces) to each other at a lateral part of the second conveying member 56. One and the other dispersing members 57 are arranged at an interval of 180° in a circumferential direction of the rotary shaft 541. The pair of dispersing members 57 are connected to each other at end portions 571A thereof by a connecting piece 572A. A central part of the connecting piece 572A is fixed to the vicinity of the first end portion 542 of the rotary shaft 541. End portions 571B of the pair of dispersing members 57 are connected by a similar connecting piece 572B also at the second end portion 543 side. Specifically, the rotary shaft 541, the second conveying member 56 and the dispersing members 57 are united by the connecting pieces 572A, 572B, so that the second conveying member 56 and the dispersing members 57 integrally rotate when the rotary shaft 541 rotates. The dispersing members 57 are arranged over both the first and second sections 54A, 54B (FIGS. 10 to 14).

The configurations of the first conveying member 55, the second conveying member 56 and the pair of dispersing members 57 are described in more detail. The second conveying member 56 is composed of a plurality of semicircular arch-like conveying pieces, which are united by the pair of dispersing members 57. As a result, the spiral second conveying member 56 including a hollow part near an axial center is formed. An inner diameter of the hollow part of the second conveying member 56 is larger than a spiral outer diameter of the first conveying member 55. In the configuration of the rotary member 54 of this embodiment, the rotary shaft 541 including the first conveying member 55 on the circumferential surface is concentrically inserted in the above hollow part. Note that a spiral direction of the first conveying member 55 and that of the second conveying member 56 are opposite.

The spiral piece 56R is a semicircular arch-like conveying piece extending between the pair of dispersing members 57. The spiral piece 56R is arranged at a predetermined distance from the second conveying member 56 toward the second end portion 543 (downstream side in the second conveying direction). This spiral piece 56R has substantially the same size as the arch-like conveying pieces of the second conveying member 56. However, the spiral piece 56R is so arranged that a spiral direction thereof is opposite to that of the arch-like conveying pieces of the second conveying member 56. The spiral piece 56R is arranged near a boundary between the first section 54A and the second section 54B and at a predetermined distance from an end portion 561 of the second conveying member 56 in the axial direction of the rotary shaft 541. The spiral piece 56R rotates together with the dispersing members 57 with the rotation of the rotary shaft 541. The spiral piece 56R conveys the toner in the first conveying direction from the tubular portion 52 toward the container main body 51.

The first film 80 is arranged between the second conveying member 56 and the spiral piece 56R in the axial direction of the rotary shaft 541 and has a function of agitating the toner in the container main body 51. In other words, the first film 80 is arranged on a downstream side in the second conveying direction from the container main body 51 toward the tubular portion 52 out of the first section 54A of the rotary member 54. As shown in FIGS. 10 to 14, the first film 80 is a thin and flexible PPS (polyphenylene sulfide) resin film having a T shape. The first film 80 also has a function of cleaning an inner wall of the container main body 51 toward which a sensor 90 to be described later is facing. The first film 80 projects from the circumferential surface of the first section 54A of the rotary shaft 541 in a direction (radial direction of the rotary shaft 541) perpendicular to the axial direction of the rotary shaft 541. The first film 80 includes a first fixed end portion 80*a* fixed onto the circumferential surface of the rotary shaft 541 and a first free end portion 80*b* (first end portion) extending up to a side radially outward of the second conveying member 56 (see FIGS. 10 and 15B).

The T shape of the first film 80 is composed of a relatively narrow base end portion 80*d* radially extending from the first fixed end portion 80*a* and a tip portion 80*e* extending further radially outward from this base end portion 80*d* and wider than the base end portion 80*d*. The tip portion 80*e* is located radially outward of a part of the second conveying member 56 having a maximum outer diameter. A length of the first free end portion 80*b* in the axial direction of the rotary shaft 541 is set to be longer than that of the first fixed end portion 80*a* in the axial direction. A long hole portion 80*c* (FIG. 10) is provided on the base of the first fixed end portion 80*a*. The long hole portion 80*c* is engaged with a holding piece 541*a* (FIG. 13) arranged on the rotary shaft 541. By this engagement, the first film 80 is united with the rotary shaft 541 and driven and rotated together with the rotary shaft 541. Further, the first film 80 is in contact with the inner wall surface of the container main body 51. Note that, in this embodiment, a virtual bite amount when the first film 80 comes into contact with the inner wall surface of the container main body 51 is preferably 13 mm or longer and 23 mm or shorter.

The second film 81 is arranged at a distance from the first film 80 in the circumferential direction of the rotary shaft 541. In this embodiment, the second film 81 extends toward a side opposite to the first film 80 in the radial direction of the rotary shaft 541. More specifically, the second film 81 is arranged at an interval of 180° from the first film 80 in the circumferential direction. The second film 81 radially projects from the circumferential surface of the first section 54A of the rotary shaft 541 and extends to a side outward of the second conveying member 56 in the radial direction. An extension length of the second film 81 is shorter than the first film 80. The second film 81 has a rectangular shape having a smaller width than the first fixed end portion 80*a* of the first film 80 in the axial direction. In this embodiment, the second film 81 is made of a PET film relatively harder than the first film 80.

Figure 15B:
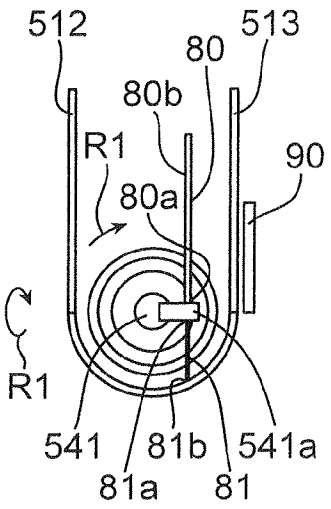
FIG. 15A is a schematic side view in section and FIG. 15B is a sectional view of the toner container showing a toner conveying operation by the rotary member.

As shown in FIGS. 10 and 15B, the second film 81 includes a second fixed end portion 81*a*. The second fixed end portion 81*a* is fixed to the rotary shaft 541 integrally with the first fixed end portion 80*a* of the first film 80. As a result, the second film 81 is driven and rotated integrally with the rotary shaft 541. Further, the second film 81 includes a second free end portion 81*b* (second end portion). The second free end portion 81*b* extends to a side opposite to the first free end portion 80*b* of the first film 80. The second free end portion 81*b* is an end portion extending to a side radially outward of the second conveying member 56 similarly to the first free end portion 80*b*, but has a shorter extension length than the first free end portion 80*b*. The second film 81 comes into contact with the inner wall surface of the container main body 51. Note that, in this embodiment, a virtual bite amount when the second film 81 comes into contact with the inner wall surface of the container main body 51 is preferably 5 mm or shorter.

A relationship of the first film 80, the second film 81, the second conveying member 56 and the spiral piece 56R is further described. In an area in the axial direction of the rotary shaft 541 where the first film 80 is arranged, a spiral part of the second conveying member 56 is not arranged in an area where a rotational path of an outer edge part of the second conveying member 56 and the first film 80 intersects in a cross-section intersecting with the rotary shaft 541. Thus, even if the first film 80 is curved toward a downstream side in a rotating direction with the rotation of the rotary member 54, the spiral part of the second conveying member 56 and the first film 80 are unlikely to interfere with each other. This point is shown in FIGS. 16A and 16B. Since the spiral part of the second conveying member 56 is not present in an area 56C where a rotational path 56M of the outer edge part of the second conveying member 56 and the first film 80 intersect, the first film 80 can be curved toward the downstream side in the rotating direction without being interfered with by the second conveying member 56.

In a front view intersecting with the axial direction of the rotary shaft 541, the end portion 561 (see FIGS. 10, 11 and 13) on the downstream side in the second conveying direction out of the spiral part of the second conveying member 56 is arranged at a first angle of inclination θ1 (FIG. 11) to the rotary shaft 541 in an area in the axial direction where the first film 80 is arranged. Contrary to this, the spiral piece 56R is partly spirally arranged at a second angle of inclination θ2 (FIG. 11) to the rotary shaft 541 in a direction intersecting with the end portion 561 while being spaced downstream of the end portion 561 of the second conveying member 56 in the second direction.

The first film 80 is arranged at least between the second conveying member 56 and the spiral piece 56R in the axial direction of the rotary shaft 541 (FIG. 10). When the rotary member 54 rotates about the rotary shaft 541 (arrow R1 in FIGS. 13 and 14), the first film 80 is curved in the circumferential direction (arrows R2 in FIGS. 13 and 14) while being held in contact with the inner wall surface of the container main body 51. As a result, the first film 80 is so curved that a space between the second conveying member 56 and the spiral piece 56R faces an area 80Z spreading along the inclinations of the second conveying member 56 (end portion 561) and the spiral piece 56R. The second film 81 projects from the rotary shaft 541 in a space 81Z enclosed by the second conveying member 56, the spiral piece 56R and the curved first film 80 (FIG. 13). Thus, the second conveying member 56 and the spiral piece 56R are arranged in an area where the second film 81 extends, in the circumferential direction of the rotary shaft 541.

<Toner Conveying Direction of Each Member>

When a rotational drive force for rotating the rotary shaft 541 in a predetermined rotating direction is applied to the container gear 54G, each of the first and second conveying members 55, 56 generates a toner conveying force according to the spiral direction thereof. The second conveying member 56 conveys the toner in the direction (second conveying direction) from the container main body 51 toward the tubular portion 52 (the toner discharge opening 521). That is, the second conveying member 56 conveys the toner from the first end portion 542 of the rotary shaft 541 toward the second end portion 543. Contrary to this, the first conveying member 55 conveys the toner in a returning direction (first conveying direction) from the tubular portion 52 toward the container main body 51. That is, the first conveying member 55 conveys the toner from the second end portion 543 toward the first end portion 542 of the rotary shaft 541.

On the other hand, the dispersing members 57 function to disperse the toner being conveyed by the first and second conveying members 55, 56 radially outwardly of the rotary shaft 541. That is, the dispersing members 57 disperse the toner present around the toner, to which a thrust force is applied by the spiral pieces of the first or second conveying member 55 or 56, radially outwardly. This promotes the movement of the toner in the first or second conveying direction.

The spiral piece 56R conveys the toner in the first conveying direction as described above since being arranged in a direction opposite to the spiral direction of the second conveying member 56. The spiral piece 56R generates a conveying force to actively return the toner from the tubular portion 52 to the container main body 51 near the boundary between the container main body 51 and the tubular portion 52.

<Description on Operation of Rotary Member>

Figure 15A:
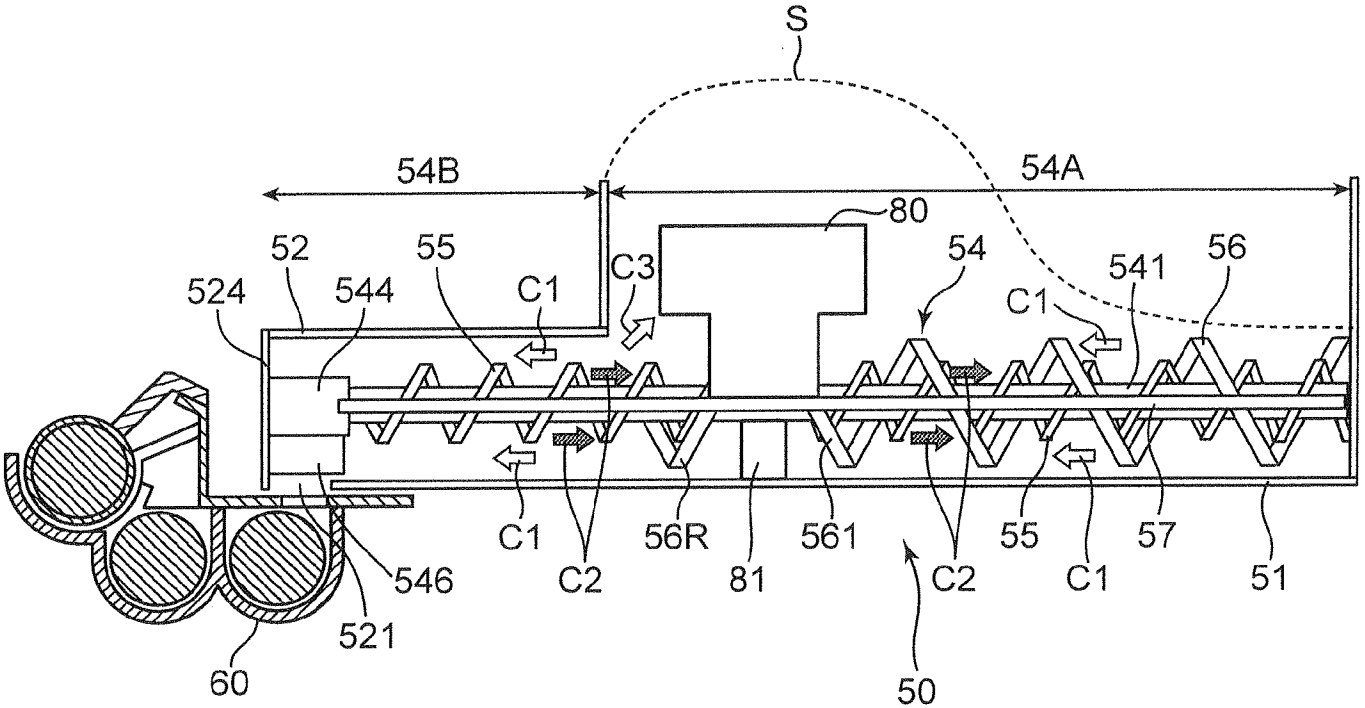

As described above, the rotary member 54 of this embodiment has an ability to convey the toner in mutually different directions at the radially inner side (first conveying member 55) and the radially outer side (second conveying member 56). Next, a toner conveying operation by this rotary member 54 is described based on FIGS. 15A and 15B. FIG. 15A is a side view in section along the axial direction of the rotary shaft 541 of the toner container 50 and FIG. 15B is a sectional view in a direction perpendicular to the rotary shaft 541 showing the toner conveying operation by the rotary member 54.

With reference to FIG. 15A, the second conveying member 56 applies a pushing force to move the toner in the second conveying direction by being driven and rotated. The toner being moved toward the tubular portion 52 by the second conveying member 56 exclusively moves near the outer peripheral part of the rotary member 54 as shown by arrows C1 in FIG. 15A. In this embodiment, the second conveying member 56 is not present in the tubular portion 52. However, the dispersing members 57 present substantially on the same rotation path as the second conveying member 56 in the radial direction of the rotary shaft 541 cause the toner near the inner peripheral wall of the tubular portion 52 to flow. Thus, a thrust force of the toner in the second conveying direction is maintained. Therefore, the toner moves toward the other end portion 524 as shown by the arrows C1 in a part near the inner peripheral wall also in the tubular portion 52.

The toner conveyed in the second conveying direction eventually reaches the other end portion 524 of the tubular portion 52. A part of the toner that has reached drops into the development housing 60 through the toner discharge opening 521 by being pushed by the film member 546.

On the other hand, the toner that has not been discharged through the toner discharge opening 521 is exclusively reversely conveyed in the first conveying direction in a part near the rotary shaft 541 in the tubular portion 52 as shown by arrows C2 in FIG. 15A by driving the first conveying member 55. The reversely conveyed toner eventually passes the boundary between the tubular portion 52 and the container main body 51 and is returned to the container main body 51, coupled with a dispersion effect by the dispersing members 57.

At this time, the spiral piece 56R further promotes the above reversely conveying function. In the tubular portion 52, the range of the toner moving radially outwardly of the rotary shaft 541 is limited and such a movement range of the toner is relatively small also near the boundary between the tubular portion 52 and the container main body 51. Near such a boundary, a pushing force in a direction of an arrow C3 of FIG. 15A to feed the toner from the tubular portion 52 to the container main body 51 can be generated by rotating the spiral piece 56R. The toner that has been pushed back in the direction of the arrow C3 is dispersed radially outwardly of the rotary shaft 54 by driving and rotating the dispersing members 57. Accordingly, collision of the toner conveyed in the forward direction, i.e. in the second conveying direction by the second conveying member 56 and the toner conveyed in the reverse direction, i.e. in the first conveying direction by the first conveying member 55 is alleviated and the toner can be smoothly returned from the tubular portion 52 to the container main body 51.

As just described, the toner container 50 of this embodiment has a circulatingly conveying function of returning the toner, which has been fed to the tubular portion 52 by the second conveying member 56, to the container main body 51 by the first conveying member 55. Thus, even in the toner container 50 structured such that the toner discharge opening 521 is provided at the tip of the tubular portion 52, the aggregation of the toner near the toner discharge opening 521 can be suppressed.

Specifically, the tubular portion 52 is a part including a narrow tubular inner space having an inner diameter somewhat larger than the spiral outer diameter of the second conveying member 56. When the rotary member 54 only has a function of conveying the toner in the second conveying direction in the toner container 50 including such a tubular portion 52, the toner eventually has nowhere to go and is packed in the tubular portion 52 and finally aggregated if a toner discharge amount is less than a toner feed amount. This causes a problem that the toner discharge opening 521 is clogged with the aggregated mass of the toner and the toner cannot be discharged.

Contrary to this, since the first conveying member 55 is arranged in the tubular portion 52 and has a function of reversely conveying the toner in the first conveying direction in the toner container 50 of this embodiment, the toner is not packed. Specifically, since being unable to move radially outwardly in the tubular portion 52, the toner tries to move in the axial center direction of the tubular portion 52. The first conveying member 55 is arranged in an axial central part to convey the toner in the first conveying direction. Thus, the toner can be efficiently returned from the tubular portion 52 to the container main body 51 before being aggregated.

<Concerning First and Second Films>

As described above, in this embodiment, the rotary member 54 includes the first and second conveying members 55, 56. A virtual cylindrical part having a size corresponding to a rotation area of the most radially projecting part of the second conveying member 56 is formed by the rotation of the rotary member 54. The toner is smoothly moved in the axial direction by the rotation of the rotary member 54 in areas inside and proximately outside this cylindrical part. By the way, the fluidity of the toner may become poor depending on an installation environment of the toner container 50 or the like. In this case, the toner stored in the toner container may aggregate in a tunnel-like manner in an area further outside of the vicinity of the cylindrical part where the rotational force of the second conveying member 56 is unlikely to reach.

Figure 16D:
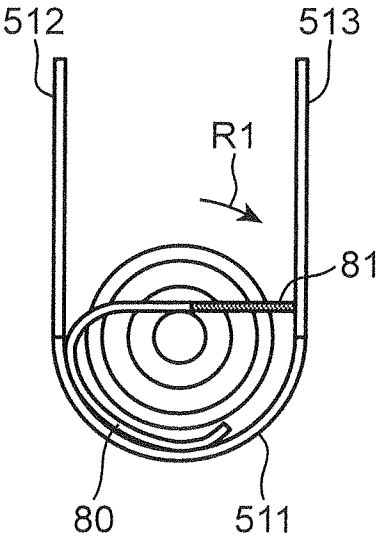
FIGS. 16A to 16D are sectional views of the toner container showing movements of first and second films.
Figure 16C:
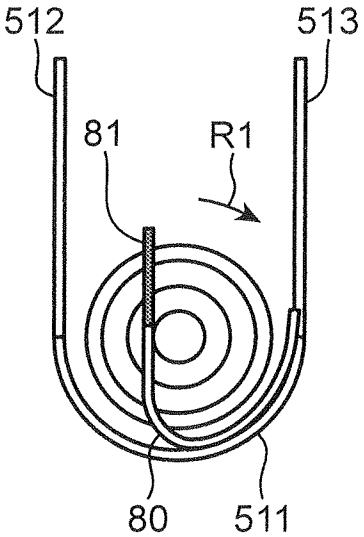
Figure 16B:
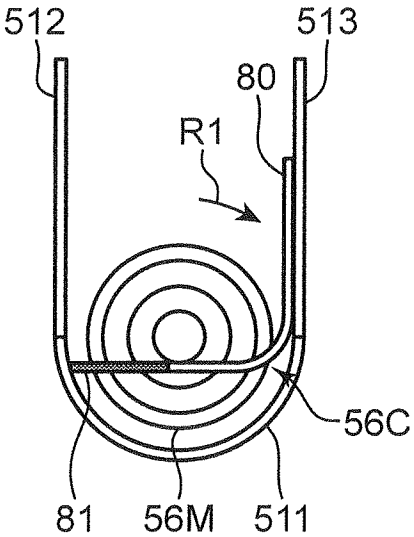
Figure 16A:
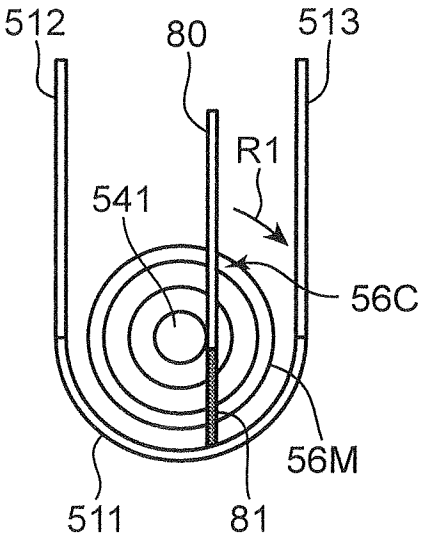
Figure 17B:
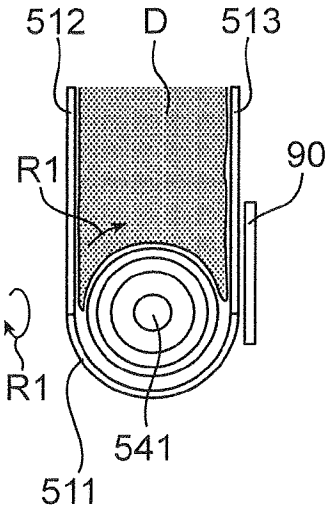
FIGS. 17A and 17B are diagrams showing a state of tunnel-like aggregation produced in the toner container.
Figure 17A:
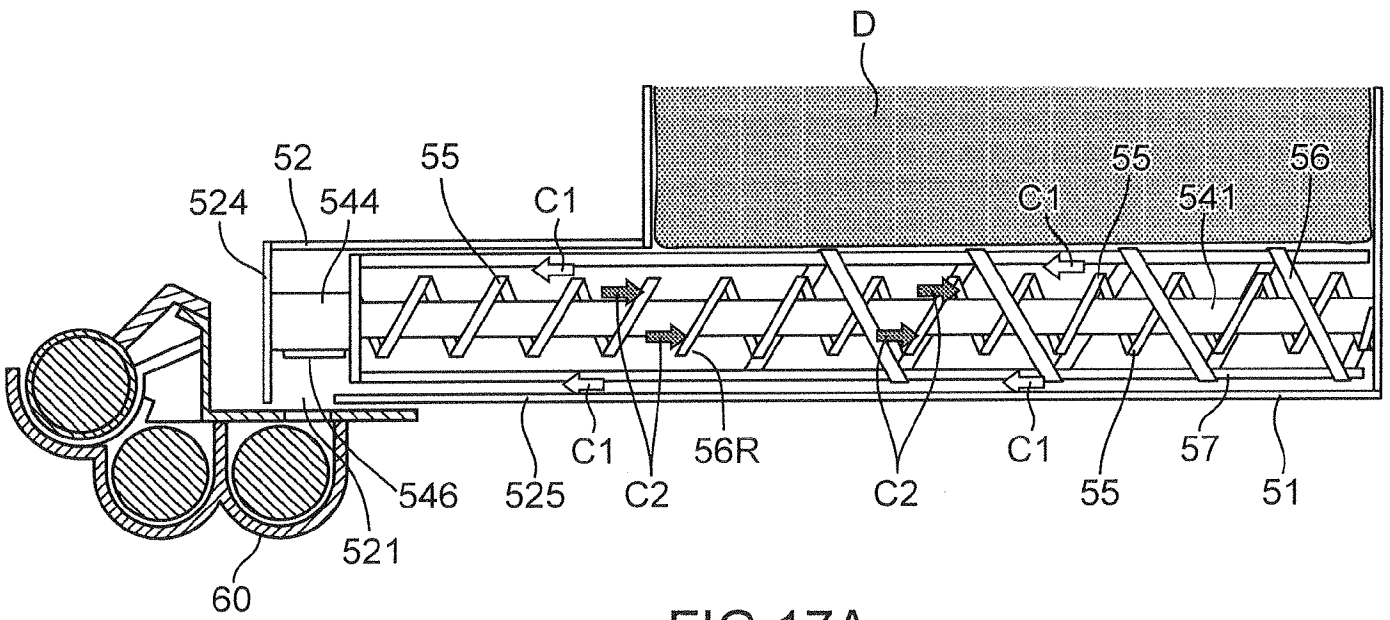

FIG. 17A is a diagrammatic side view in section along the axial direction of the rotary shaft 541 of the toner container 51 showing such aggregation of the toner and FIG. 17B is a sectional view in a direction perpendicular to the rotary shaft 541. The tunnel-like toner aggregation is shown in an area D of FIGS. 17A and 17B. Even in such a case, the toner arranged outside the cylindrical shape can be agitated by the first film 80 (first flexible member) arranged on the rotary shaft 541. FIGS. 16A to 16D are sectional views showing movements of the first and second films 80, 81 with the rotation of the rotary shaft 54 about the rotary shaft 541.

The first film 80 is rotated in a direction of an arrow R1 together with the rotary shaft 541 in the container main body 51. At this time, when the rotary shaft 541 rotates 90° in the direction of the arrow R1 from a state of FIG. 16A to a state of FIG. 16B, the first film 80 comes into contact with the inner surface of the second side wall 513 while being deflected toward an upstream side (direction opposite to that of the arrow R1) in the rotating direction.

Further, with the rotation of the rotary shaft 541, the first film 80 moves the toner near the inner surfaces in the direction of the arrow R1 while successively coming into contact with the inner surfaces of the second side wall 513, the bottom wall 511 and the first side wall 512 (FIGS. 16B to 16D). Further, since the first film 80 is made of a PPS film, an elastic force of the first film 80 is released and the first film 80 functions to strike the toner around the first film 80 when the tip (first free end portion 80*b*) leaves the inner surface of the first side wall 512. This promotes the fluidity of the surrounding toner. Here, the length of the first free end portion 80*b* of the first film 80 in the axial direction of the rotary shaft 541 is set to be longer than the length of the first fixed end portion 80*a* in the axial direction of the rotary shaft 541. Thus, the first free end portion 80*b* of the first film 80 can agitate the toner in a wider range in the container main body 51.

Further, the first film 80 is arranged on the downstream side of the first section 54A in the second conveying direction, i.e.

near the boundary between the first and second sections 54A, 54B in the axial direction of the rotary shaft 541. Thus, the toner moved from the second section 54B toward the first section 54A by the first conveying member 55, the dispersing members 57 and the spiral piece 56R is pushed upward in the container main body 51 by a rotational force of the first film 80. The toner pushed upward of the first film 80 moves in the first conveying direction to collapse a heap of the toner in the container main body 51 (see dotted line S of FIG. 15A) and is conveyed in the second conveying direction again by the second conveying member 56. In this way, the toner located above the rotary member 54 is caused to flow in a circulating manner by the rotation of the first film 80. Therefore, even in an environment where the fluidity of the toner is deteriorated, the tunnel-like aggregation of the toner in the container main body 51 is suppressed.

Further, in this embodiment, the sensor 90 is arranged to face a position of the second side wall 513 where the first free end portion 80*b* of the first film 80 comes into contact as shown in FIG. 15B. The sensor 90 is used to notify an exchange timing of the toner container 50 by detecting the toner stored in the toner container 50.

The sensor 90 is a plate-like magnetic sensor and outputs a voltage signal corresponding to a remaining amount of the toner in the toner container 50. Specifically, the sensor 90 outputs a high voltage if the toner is present at the position facing the sensor 90 while outputting a low voltage if the toner is absent. However, the toner may adhere to each inner surface of the toner container 50. If the toner in the toner container 50 is nearly used up with the toner adhering to the inner surface of the second side wall 513 facing the sensor 90, the sensor 90 erroneously continues to output a high voltage and it cannot be correctly detected that the toner container 50 is emptied of the toner.

Even in such a case, in this embodiment, the first free end portion 80*b* of the first film 80 rotates while coming into contact with a part of the inner surface of the second side wall 513 facing the sensor 90. Thus, the first free end portion 80*b* can scrape off the toner adhering to the inner surface of the second side wall 513. Therefore, erroneous detection of the amount of the toner in the toner container 50 is suppressed.

On the other hand, when the first film 80 is rotated while being deflected along the inner surface of the bottom wall 511, i.e. along the outer peripheral edge of the second conveying member 56 of the rotary member 54 as shown in FIGS. 16A to 16D, the toner may be retained in the rotary member 54. As described above, when the rotary member 54 is rotated about the rotary shaft 541 (arrow R1 of FIGS. 13 and 14), the first film 80 is so curved that the space between the second conveying member 56 and the spiral piece 56R faces the area 80Z spreading along the inclinations of the second conveying member 56 (end portion 561) and the spiral piece 56R. At this time, with the rotation of the rotary member 54, the second conveying member 56 conveys the toner in a direction shown by an arrow AD1 of FIG. 13. Further, the spiral piece 56R conveys the toner in a direction shown by an arrow AD2 of FIG. 13. These two flows of the toner collide between the second conveying member 56 and the spiral piece 56R. Further, as described above, the first film 80 is curved to face the space between the second conveying member 56 and the spiral piece 56R. As a result, the above toner that has collided is trapped in a space enclosed by the second conveying member 56, the spiral piece 56R and the first film 80 and tends to be retained.

Even in such a case, in this embodiment, the second film 81 projects radially outward from the rotary shaft 541 in the space 81Z enclosed by the second conveying member 56, the spiral piece 56R and the curved first film 80 (FIG. 13). In other words, the second film 81 projects from the rotary shaft 541 to intrude into the space 81Z. Thus, the second film 81 has a function of feeding the toner in the hollow part to a radially outer side of the rotary shaft 541 with the rotation of the rotary member 54. As a result, the retention of the toner in the hollow part (space 81Z) of the rotary member 54 is preferably suppressed.

The second film 81 extends a shorter distance than the first film 80 from the rotary shaft 541 (extension length of the second free end portion 81*b* is shorter than the first free end portion 80*b*). This prevents the second film 81 from forming a closed space with the second conveying member 56 and the spiral piece 56R such as the one created by the first film 80 and retaining the toner. Further, similarly to the first film 80, an elastic force of the second film 81 is released and the second film 81 functions to strike the toner around the second film 81 when the tip (second free end portion 81*b*) leaves the inner surface of the second side wall 512 with the rotation of the rotary member 54. As a result, the above function of the second film 81 is further exhibited and the second film 81 can scrape off the toner in the hollow part to a radially outer side.

Although the toner container 50 and the image forming apparatus 1 according to the embodiment of the present disclosure have been described above, the present disclosure is not limited to this embodiment and can be, for example, modified as follows.

(1) In the above embodiment, the toner container 50 is illustrated as a specific example of the developer storage container. The developer storage container may be, for example, a developing unit formed by uniting a toner storage unit, a developing roller and the like or an intermediate hopper or the like interposed between the toner container and the developing device.

(2) In the above embodiment, the dispersing members 57 are formed over the entire axial length of the rotary shaft 541. Without being limited to this, the dispersing members 57 may be arranged only around the first section 54A.

(3) Although the second film 81 radially extends toward the side opposite to the first film 80 in the rotary member 54 according to the above embodiment, the present disclosure is not limited to this. The second film 81 only has to extend from the rotary shaft 541 while being spaced by a predetermined angle in the circumferential direction from the first film 80.

EXAMPLE

Next, the result of examples carried out using the rotary member 54 according to the above embodiment is described. Note that each example was carried out under the following factors and conditions.

Rotary Member 54:

Number of revolutions: 120 rpm

First conveying member 55: diameter of 7 mm, spiral pitch of 10 mm, shaft diameter of 5 mm Second conveying member 56: maximum outer diameter of 21 mm, minimum outer diameter of 17 mm, inner diameter of 14 mm, spiral pitch of 20 mm Note that the second conveying member 56 is formed by resin molding by being pulled out in the axial direction of the rotary shaft 541 from a mold. Thus, the outer diameter of the second conveying member 56 is slightly reduced from the container main body 51 toward the tubular portion 52.

Dispersing member 57: thickness of 1 mm in circumferential direction

Toner Container 50:

Container main body 51: maximum thickness of 40 mm, minimum thickness of 20 mm, length of 100 mm Tubular portion 52: minimum inner diameter of 18 mm, length of 65 mm First Film 80:

Material: PPS resin film, thickness of 0.1 mm, bite amount into the wall surface of the container main body 51 is variable Second Film 81:

Material: PET resin film, thickness of 0.1 mm, bite amount into the wall surface of the container main body 51 is variable Experiment 1

After a condition on the presence or absence of the first and second films 80, 81 was changed under the above experimental conditions, a toner discharge amount from the toner container 50 was measured. The experiment was carried out in a case where the rotary member 54 was driven for 1 hour in advance and a case where the rotary member 54 was not driven in advance with the toner discharge opening 521 closed.

TABLE 1

| | After Drive for 1 Hour | | No Previous Drive | |
|---|---|---|---|---|
| | A | B | A | B |
| First Film 80 | Present | Present | Present | Present |
| Second Film 81 | Absent | Present | Absent | Present |
| Toner Discharge Amount (g/s) | 0.05 | 0.4 | 0.4 | 0.4 |

As shown in TABLE-1, when the rotary member 54 was driven for 1 hour in advance to set a condition for easy toner aggregation, the toner discharge amount changed depending on the presence or absence of the second film 81. Specifically, in the absence of the second film 81, the toner discharge amount was reduced to 0.05 (g/sec) due to the retention of the toner in the hollow part of the rotary member 54. On the other hand, by providing the second film 81, the toner discharge amount was recovered to a level equivalent to the one when there was no previous drive.

Experiment 2

Under the previous experimental conditions, the rotary member 54 was driven for 1 hour in advance similarly with the toner discharge opening 521 of the toner container 50 closed, a drive failure due to a torque increase of the rotary member 54 was confirmed, the developing device 33 was mounted into the image forming apparatus 1 and a printing operation was performed. Thereafter, a cleaning failure of the wall surface of the container main body 51 was confirmed. In the image forming apparatus 1, if a cleaning failure of the wall surface occurs, a toner empty detection failure occurs in which, despite a state where the toner container 50 is empty of the toner, this state is not properly detected. Note that this experiment was carried out by changing a bite amount X of the first film 80 with a bite amount Y of the second film 81 set at 1 mm and an average outer diameter Z of the second conveying member 56 in an area where the first film 80 is arranged set at 18 mm. The result of this experiment is shown in TABLE-2.

TABLE 2

| | | | | | | | | | |
|---|---|---|---|---|---|---|---|---|---|
| Average diameter Z (mm) | 18 | 18 | 18 | 18 | 18 | 18 | 18 | 18 | 18 |
| First Film Bite Amount X (mm) | 12.5 | 13 | 14 | 16 | 18 | 20 | 22 | 23 | 24 |
| Ratio | 0.69 | 0.72 | 0.78 | 0.89 | 1.00 | 1.11 | 1.22 | 1.28 | 1.33 |
| Drive Failure | ○ | ○ | ○ | ○ | ○ | ○ | ○ | ○ | Δ |
| Cleaning Failure | Δ | ○ | ○ | ○ | ○ | ○ | ○ | ○ | ○ |

As a result, it was confirmed as shown in TABLE-2 that a rotational torque of the rotary member 54 was stably maintained low and the toner empty detection failure did not occur in a range of $0.7\times Z<X<1.3\times Z$. Note that the toner empty detection failure occurred (Δ in TABLE-3), although slightly, when the bite amount of the first film 80 was 12.5 mm and a slight torque increase occurred (Δ in TABLE-3) when the bite amount of the first film 80 was 24 mm.

Experiment 3

Next, the retention of the toner in the rotary member 54 when the length of the second film 81 was changed was evaluated under the previous experimental conditions. Note that this experiment was carried out by changing the bite amount Y of the second film 81 with the bite amount X of the first film 80 set at 18 mm and the average outer diameter Z of the second conveying member 56 in the area where the first film 80 is arranged set at 18 mm. The result of this experiment is shown in TABLE-3.

TABLE 3

| | | | | | | | | | |
|---|---|---|---|---|---|---|---|---|---|
| Second Film Bite Amount Y (mm) | 0 | 0.5 | 1 | 1.5 | 2 | 2.5 | 3 | 4 | 5 |
| Toner Discharge Amount After Drive (g/s) | 0.15 | 0.35 | 0.4 | 0.42 | 0.4 | 0.41 | 0.39 | 0.35 | 0.16 |
| Evaluation | Δ | ○ | ○ | ○ | ○ | ○ | ○ | ○ | Δ |

As a result, it was found out as shown in TABLE-3 that the second film 81 stably scraped the toner in the hollow part of the rotary member 54 toward the radially outer side and the toner discharge amount was stably maintained in a range of $0<Y<5$ mm. Note that the second film 81 is not curved since being not in contact with the inner wall surface of the container main body 51 when the bite amount Y of the second film 81 was 0 mm. Thus, although the toner did not aggregate, a toner discharge effect was somewhat reduced. Further, when the bite amount Y of the second film 81 was 5 mm, the second film 81 partly wound around the outer peripheral edge of the second conveying member 56. Thus, similarly, the toner discharge effect was somewhat reduced, although the toner did not aggregate. Note that although not shown in TABLE-3, the aggregation of the toner was confirmed in the hollow part of the rotary member 54 when the second film 81 was not provided.

Although the present disclosure has been fully described by way of example with reference to the accompanying drawings, it is to be understood that various changes and modifications will be apparent to those skilled in the art. Therefore, unless otherwise such changes and modifications depart from the scope of the present disclosure hereinafter defined, they should be construed as being included therein.

The invention claimed is:

1. A developer storage container, comprising:

a container main body including a bottom wall extending in one direction and configured to store developer;

a tubular portion projecting from the container main body while being connected to the bottom wall, and including a developer discharge opening through which the developer is discharged; and a rotary member extending from the container main body to the tubular portion and configured to convey the developer in the container main body;

wherein the rotary member includes:

a rotary shaft extending in an extending direction of the bottom wall and including a first section located in the container main body and a second section located in the tubular portion;

a first conveying member spirally projecting on a circumferential surface of the second section of the rotary shaft and configured to rotate together with the rotary shaft and convey the developer in a first conveying direction from the tubular portion toward the container main body;

a second conveying member spirally arranged around the first section and at a side radially outward of the first conveying member, including a hollow part through which the rotary shaft with the first conveying member is inserted, and configured to rotate together with the rotary shaft and convey the developer in a second conveying direction from the container main body toward the tubular portion;

a third conveying member spirally arranged at a second angle of inclination to the rotary shaft in a direction intersecting with the end portion of the second conveying member while being spaced downstream of the end portion of the second conveying member in the second conveying direction and configured to convey the developer in the first conveying direction;

a first flexible member projecting in a radial direction of the rotary shaft from a circumferential surface of the first section of the rotary shaft and including a first end portion extending to a side outward of the second conveying member in the radial direction; and a second flexible member radially projecting from the circumferential surface of the first section of the rotary shaft while being spaced apart in a circumferential direction of the rotary shaft from the first flexible member and including a second end portion extending in the radial direction to a side outward of the second conveying member and having a shorter length than the first flexible member, wherein a spiral part of the second conveying member is not arranged in an area where a rotational path of an outer edge part of the second conveying member and the first flexible member intersect in a cross-section intersecting with the rotary shaft in an area in an axial direction of the rotary shaft where the first flexible member is arranged;

a downstream end portion of the spiral part of the second conveying member in the second conveying direction is arranged at a first angle of inclination to the rotary shaft in the area in the axial direction where the first flexible member is arranged in a front view viewed in a direction intersecting with the axial direction of the rotary shaft;

the first flexible member is arranged at least between the second and third conveying members in the axial direction and is curved in the circumferential direction of the rotary shaft with the rotation of the rotary member about the rotary shaft so that a space between the second and third conveying members faces an area spreading along the inclinations of the second and third conveying members; and the second flexible member radially projects from the rotary shaft in a space enclosed by the second and third conveying members and the curved first flexible member.

2. The developer storage container according to claim 1, wherein:

the first section of the rotary shaft includes a part at an upstream side and a part at a downstream side in the second conveying direction, and the first and second flexible members extend from the circumferential surface of the part of the downstream side.

3. The developer storage container according to claim 1, wherein:

the second flexible member projects from the rotary shaft toward a side opposite to the first flexible member in the radial direction of the rotary shaft.

4. The developer storage container according to claim 1, wherein:

the tubular portion has an inner wall surface having a circular cross-section;

the bottom wall of the container main body has a semicircular inner wall surface corresponding to a rotation path of a most radially projecting part of the second conveying member in a radial direction of the second conveying member and the semicircular inner wall surface is connected to the circular inner wall surface of the tubular portion;

the container main body includes a first side wall extending upward from one end edge of the bottom wall and a second side wall extending upward from the other end edge of the bottom wall and facing the first side wall; and the first and second flexible members are rotated together with the rotary shaft, whereby tip portions of the first and second flexible members successively come into contact from an inner surface of the first side wall to an inner surface of the second side wall via the bottom wall.

5. The developer storage container according to claim 4, further comprising a sensor for detecting the developer stored in the developer storage container, wherein:

the sensor is mounted to face a position of the first or second side wall where the tip portion of the first flexible member comes into contact.

6. The developer storage container according to claim 5, wherein:

the first and second flexible members satisfy the following inequality in a cross-section perpendicular to the rotary shaft:

$$0.7\times Z<X<1.3\times Z(0<Y<5\text{mm})$$

where: X: maximum bite amount (mm) of the first flexible member into the container main body, Y: maximum bite amount (mm) of the second flexible member into the container main body, and Z: average outer diameter (mm) of the second conveying member in an area where the first flexible member is arranged.

7. An image forming apparatus, comprising:

an image bearing member for bearing a developer image on a circumferential surface;

a developing device including a developing roller for supplying developer to the circumferential surface of the image bearing member; and a developer storage container to be assembled with the developing device for supplying the developer to the developing device;

wherein the developer storage container includes:

a container main body including a bottom wall extending in one direction and configured to store developer;

a tubular portion projecting from the container main body while being connected to the bottom wall, and including a developer discharge opening through which the developer is discharged; and a rotary member extending from the container main body to the tubular portion and configured to convey the developer in the container main body;

the rotary member including:

a rotary shaft extending in an extending direction of the bottom wall and including a first section located in the container main body and a second section located in the tubular portion;

a first conveying member spirally projecting on a circumferential surface of the second section of the rotary shaft and configured to rotate together with the rotary shaft and convey the developer in a first conveying direction from the tubular portion toward the container main body;

a second conveying member spirally arranged around the first section and at a side radially outward of the first conveying member, including a hollow part through which the rotary shaft with the first conveying member is inserted, and configured to rotate together with the rotary shaft and convey the developer in a second conveying direction from the container main body toward the tubular portion;

a third conveying member spirally arranged at a second angle of inclination to the rotary shaft in a direction intersecting with the end portion of the second conveying member while being spaced downstream of the end portion of the second conveying member in the second conveying direction and configured to convey the developer in the first conveying direction;

a first flexible member projecting in a radial direction of the rotary shaft from a circumferential surface of the first section of the rotary shaft and including a first end portion extending to a side outward of the second conveying member in the radial direction; and a second flexible member radially projecting from the circumferential surface of the first section of the rotary shaft while being spaced apart in a circumferential direction of the rotary shaft from the first flexible member and including a second end portion extending in the radial direction to a side outward of the second conveying member and having a shorter length than the first flexible member, wherein a spiral part of the second conveying member is not arranged in an area where a rotational path of an outer edge part of the second conveying member and the first flexible member intersect in a cross-section intersecting with the rotary shaft in an area in an axial direction of the rotary shaft where the first flexible member is arranged;

a downstream end portion of the spiral part of the second conveying member in the second conveying direction is arranged at a first angle of inclination to the rotary shaft in the area in the axial direction where the first flexible member is arranged in a front view viewed in a direction intersecting with the axial direction of the rotary shaft;

the first flexible member is arranged at least between the second and third conveying members in the axial direction and is curved in the circumferential direction of the rotary shaft with the rotation of the rotary member about the rotary shaft so that a space between the second and third conveying members faces an area spreading along the inclinations of the second and third conveying members; and the second flexible member radially projects from the rotary shaft in a space enclosed by the second and third conveying members and the curved first flexible member.

8. The image forming apparatus according to claim 7, wherein:

the first section of the rotary shaft includes a part at an upstream side and a part at a downstream side in the second conveying direction, and the first and second flexible members extend from the circumferential surface of the part of the downstream side.

9. The image forming apparatus according to claim 7, wherein:

the second flexible member projects from the rotary shaft toward a side opposite to the first flexible member in the radial direction of the rotary shaft.

10. The image forming apparatus according to claim 7, wherein:

the tubular portion has an inner wall surface having a circular cross-section;

the bottom wall of the container main body has a semicircular inner wall surface corresponding to a rotation path of a most radially projecting part of the second conveying member in a radial direction of the second conveying member and the semicircular inner wall surface is connected to the circular inner wall surface of the tubular portion;

the container main body includes a first side wall extending upward from one end edge of the bottom wall and a second side wall extending upward from the other end edge of the bottom wall and facing the first side wall; and the first and second flexible members are rotated together with the rotary shaft, whereby tip portions of the first and second flexible members successively come into contact from an inner surface of the first side wall to an inner surface of the second side wall via the bottom wall.

11. The image forming apparatus according to claim 10, further comprising a sensor for detecting the developer stored in the developer storage container, wherein:

the sensor is mounted to face a position of the first or second side wall where the tip portion of the first flexible member comes into contact.

12. The image forming apparatus according to claim 11, wherein:

the first and second flexible members satisfy the following inequality in a cross-section perpendicular to the rotary shaft:

$$0.7\times Z<X<1.3\times Z\ (0<Y<5\ \text{mm})$$

where: X: maximum bite amount (mm) of the first flexible member into the container main body, Y: maximum bite amount (mm) of the second flexible member into the container main body, and Z: average outer diameter (mm) of the second conveying member in an area where the first flexible member is arranged.

13. A developer storage container, comprising:

a container main body including a bottom wall extending in one direction and configured to store developer, the bottom wall of the container main body having a semicircular inner wall surface, the container main body further including a first side wall extending up from one end edge of the bottom wall and a second side wall extending up from the other end edge of the bottom wall and facing the first side wall;

a sensor for detecting the developer stored in the developer storage container;

a tubular portion projecting from the container main body while being connected to the bottom wall, and including a developer discharge opening through which the developer is discharged, the tubular portion having an inner wall surface with a circular cross-section and the semicircular inner wall surface of the container main body being connected to the circular inner wall surface of the tubular portion; and a rotary member extending from the container main body to the tubular portion and configured to convey the developer in the container main body, the rotary member including:

a rotary shaft extending in an extending direction of the bottom wall and including a first section located in the container main body and a second section located in the tubular portion;

a first conveying member spirally projecting on a circumferential surface of the second section of the rotary shaft and configured to rotate together with the rotary shaft and convey the developer in a first conveying direction from the tubular portion toward the container main body;

a second conveying member spirally arranged around the first section and at a side radially outward of the first conveying member, including a hollow part through which the rotary shaft with the first conveying member is inserted, and configured to rotate together with the rotary shaft and convey the developer in a second conveying direction from the container main body toward the tubular portion, the semicircular inner wall surface of the bottom wall of the container main body corresponding to a rotation path of a most radially projecting part of the second conveying member in a radial direction of the second conveying member;

a first flexible member projecting in a radial direction of the rotary shaft from a circumferential surface of the first section of the rotary shaft and including a first end portion extending to a side outward of the second conveying member in the radial direction; and a second flexible member radially projecting from the circumferential surface of the first section of the rotary shaft while being spaced apart in a circumferential direction of the rotary shaft from the first flexible member and including a second end portion extending in the radial direction to a side outward of the second conveying member and having a shorter length than the first flexible member, wherein the first and second flexible members are rotated together with the rotary shaft, whereby tip portions of the first and second flexible members successively come into contact from an inner surface of the first side wall to an inner surface of the second side wall via the bottom wall;

the sensor is mounted to face a position of the first or second side wall where the tip portion of the first flexible member comes into contact; and the first and second flexible members satisfy the following inequality in a cross-section perpendicular to the rotary shaft:

$$0.7 \times Z < X < 1.3 \times Z \ (0 < Y < 5 \text{ mm})$$

where:

X: maximum bite amount (mm) of the first flexible member into the container main body, Y: maximum bite amount (mm) of the second flexible member into the container main body, and Z: average outer diameter (mm) of the second conveying member in an area where the first flexible member is arranged.

* * * * *